US005255011A

United States Patent [19]

Minowa et al.

[11] Patent Number: 5,255,011

[45] Date of Patent: Oct. 19, 1993

[54] THERMAL PRINTER DRIVE CONTROL APPARATUS AND METHOD OF CONTROLLING THERMAL PRINT HEAD

[75] Inventors: Masahiro Minowa; Naoki Kobayashi; Satoshi Nakajima; Tadashi Furuhata, all of Suwa, Japan

[73] Assignee: Seiko Epson Corporation, Japan

[21] Appl. No.: 592,695

[22] Filed: Oct. 3, 1990

[30] Foreign Application Priority Data

Oct. 3, 1989 [JP] Japan ..... 1-258212
Oct. 12, 1989 [JP] Japan ..... 1-265675
Oct. 12, 1989 [JP] Japan ..... 1-265676

[51] Int. Cl.[5] ..... B41J 2/32
[52] U.S. Cl. ..... 346/76 PH
[58] Field of Search ..... 346/76 PH

[56] References Cited

U.S. PATENT DOCUMENTS 4,590,484 5/1986 Matsushita ..... 346/76 PH
4,675,695 6/1987 Samuel ..... 346/1.1
4,845,514 7/1989 Mitsushima et al. ..... 346/76 PH
4,983,054 1/1991 Nishiura ..... 400/120
5,025,267 6/1991 Schofield et al. ..... 346/1.1

FOREIGN PATENT DOCUMENTS 170367 7/1987 Japan .
160657 6/1989 Japan .

*Primary Examiner*—Benjamin R. Fuller
*Assistant Examiner*—Huan Tran
*Attorney, Agent, or Firm*—W. Douglas Carothers, Jr.

[57] ABSTRACT

A thermal printer drive control apparatus of the type having a thermal print head comprising a plurality of heating elements provides for reliable cost effective thermal head temperature detection by means of producing multiple, different current flow intervals that are applied to binary data to produce data drive signals for the heating elements. The current flow intervals are based upon historical drive data derived from linear temperature conditions sensed at the thermal print head. This information is converted to a digitized representation for use in conjunction with a table placed in memory that provides predetermined current flow intervals based upon the digitized representation. Further, circuitry is provided to produce heating element drive signals having pulse widths based upon the determined current flow intervals.

20 Claims, 14 Drawing Sheets

| $A_2$ | $A_1$ | $A_0$ | FUNCTIONS |
|---|---|---|---|
| 0 | 0 | 0 | LATCH CIRCUIT DATA RESET |
| 0 | 0 | 1 | DATA INPUT TO LATCH CIRCUIT *21* |
| 0 | 1 | 0 | DATA INPUT TO LATCH CIRCUIT *24* |
| 0 | 1 | 1 | DATA INPUT TO LATCH CIRCUIT *27* |
| 1 | 0 | 0 | CIRCUIT *34* RESET SIGNAL INPUT |
| 1 | 0 | 1 | CIRCUIT *34* CLOCK SIGNAL INPUT |

| 71 THERMISTOR TEMPERATURE | 72 $V_t$ OUTPUT VOLTAGE (V) | 73 OUTPUT CODE | 77 | 74 STANDARD PULSE WIDTH RATIO | 75 STANDARD PULSE WIDTH TW (μs) |
|---|---|---|---|---|---|
| 0°C | 0.638 | 28 H | | 1.41 | 564 |
| 10°C | 0.985 | 3D H | | 1.28 | 512 |
| 20°C | 1.422 | 5A H | | 1.10 | 440 |
| 25°C | 1.667 | 6A H | | 1.00 | 400 |
| 30°C | 1.921 | 7A H | | 0.90 | 360 |
| 40°C | 2.438 | 9B H | | 0.70 | 280 |
| 50°C | 2.928 | BA H | | 0.50 | 200 |
| 60°C | 3.360 | D6 H | | 0.33 | 132 |

1 = 400 μs 76

| | PRINTING MODE | $t_3$ | $t_2$ | $t_1$ | $t_0$ | |
|---|---|---|---|---|---|---|
| 81 | THERMAL TRANSFER ONE TIME | 80 | 40 | 20 | 100 | 84 |
| 82 | THERMAL TRANSFER MULTIPLE TIMES | 90 | 50 | 30 | 100 | 85 |
| 83 | THERMAL PAPER | 60 | 30 | 10 | 120 | 86 |

| $R_v$ (kΩ) | $V_k$ OUTPUT POTENTIAL (V) | DENSITY CORRECTION VALVE (COEFFICIENT) |
|---|---|---|
| $50 \geq R_v \geq 45$ | 2.50 ~ 2.63 | 1.2 |
| $45 > R_v \geq 40$ | 2.63 ~ 2.78 | 1.1 |
| $40 > R_v \geq 35$ | 2.78 ~ 2.94 | 1.0 |
| $35 > R_v \geq 30$ | 2.94 ~ 3.13 | 0.9 |
| $30 > R_v \geq 25$ | 3.13 ~ 3.33 | 0.8 |
| $25 > R_v \geq 20$ | 3.33 ~ 3.57 | 0.7 |
| $20 > R_v$ | 3.57 ~ | 0.6 |

$R_v$ = RESISTANCE VALVE OF RESISTOR *191*

*FIG._17*

| 271 THERMISTOR TEMPERATURE | 272 $V_t$ OUTPUT VOLTAGE (V) | 273 OUTPUT CODE | 274 STANDARD PULSE WIDTH RATIO | 275 STANDARD PULSE WIDTH TW (μs) |
|---|---|---|---|---|
| 0°C | 0.638 | 28 H | 1.15 | 460 |
| 10°C | 0.985 | 3D H | 1.10 | 440 |
| 20°C | 1.422 | 5A H | 1.04 | 416 |
| 25°C | 1.667 | 6A H | 1.00 | 400 |
| 30°C | 1.921 | 7A H | 0.95 | 380 |
| 40°C | 2.438 | 9B H | 0.84 | 336 |
| 50°C | 2.928 | BA H | 0.69 | 276 |
| 60°C | 3.360 | D6 H | 0.53 | 212 |

277

1 = 400 μs 276

*FIG._20*

| AMBIENT TEMPERATURE | CORRECTION COEFFICIENT |
|---|---|
| 0°C | 1.31 |
| 10°C | 1.18 |
| 20°C | 1.12 |
| 25°C | 1.00 |
| 30°C | 0.95 |
| 40°C | 0.84 |

THERMAL PRINTER DRIVE CONTROL APPARATUS AND METHOD OF CONTROLLING THERMAL PRINT HEAD

BACKGROUND OF THE INVENTION

This invention relates generally to control of thermal printers and more particularly to methods and apparatus for controlling the energization of a thermal print head in a thermal printer based upon the historical temperature driving conditions at the thermal print head.

A variety of methods have been utilized relative to present day thermal printers to prevent a deterioration in printing quality caused by the accumulation of heat at thermal print head due to continuous thermal operation of the thermal print head. Among the methods employed is a method of holding in memory printing data for each dot to be printed and determining the current flow time to be applied to the thermal print head heating elements based upon the spatial sequence of dots to be printed, such as, disclosed in Japanese patent application No. 55-48631, and a method of changing the current flow time of the pulse to thermal print head heating elements based upon the printing activity of previous print data, such as, disclosed in Japanese patent application No. 57-18507. These forgoing methods may be generally referred to as historical control methods since they contemplate the variance of the pulse width of the drive pulses to be applied to thermal print head heating elements based on previous historical drive data.

In addition, historical thermal print head temperature data methods have been developed that control the applied energization to the thermal print head printing elements based on temperature conditions sensed at the thermal print head. Japanese patent Nos. 61-130063 and 59-7068 are examples of applied thermal print head energy control circuits that measure the baseplate material temperature of the thermal print head employing, in combination, a thermistor and A/D converter and, in turn, calculating means determines the amount of increase or decrease in the applied energy to each heating element of the thermal print head based upon the determined head temperature. In all of these types of thermal printer head temperature compensating and adjustment methods, complicated calculations are utilized in connection with the detected output values of the A/D converter to determine values, such as, the applied energy pulse width and the applied voltage values to the current drivers for operation of the thermal print head heating elements.

In addition, the general method with these historical control method has been sending data sequentially to the thermal head drive IC while generally processing data by means of a CPU. In employing such a method, even if an attempt was made to operate the thermal printer at a high operating speed, the processing of data is not sufficient fast to keep up with the printing operation, which has been a detriment toward the ability to increase the speed of thermal printers.

Reference is made to FIG. 14 which illustrates a conventional thermistor temperature detection circuit comprising the linearized circuits of a thermistor and the A/D converter employed in historical thermal print head temperature data methods. In general, divider circuit 125 comprises resistor 121 connected in parallel with thermistor 120 and resistor 122 is connected in series to thermistor 120 and to the power supply to form a linearized circuit. The voltage potential $V_p$ of voltage divider point 123 of voltage divider circuit 125 is the detected input 115 to A/D converter 110. A/D converter 110 provides an output representing this electric potential in binary code and a CPU connected to A/D converter 110 will read this code and perform arithmetic processing to determine adjustments to be made to the level of energization of thermal print head heating elements. A/D converter 110 is connected via line 112 to the positive (+) terminal of the power supply 112 and via line 114 to the negative (−) terminal of the power supply. Input line 113 to A/D converter 110 is for the detection range setting, and the same power supply is connected as input as in the case of line 112.

FIG. 15 is a graph illustrating the relationship between the electric potential, $V_p$, of voltage divider point 123 of the circuit of FIG. 14 and the temperature of thermistor 120. In this example, at 25° C., thermistor 120 is $R_{th}=50$ kilohms, resistor 122 is $R_1=60$ kilohms and resistor 121 is $R_2=500$ kilohms. The electric potential, $V_p$, at point 123 will vary with changes in resistance of thermistor 120 relative to the fixed resistances of resistors $R_1$ and $R_2$. However, as is clear from characteristic curve 131 in FIG. 15, the output electrical potential, $V_p$, reaches saturation as the temperature of thermistor 120 increases since curve 131 increasing flattens out with higher temperature. In addition, because a large voltage range cannot be obtained in the thermistor operating temperature range of 0° C. and 60° C., the electric potential per one unit step increases monotonically and, as a result, the range of the A/D converter detection potential monotonically increases so that detection accuracy is limited at higher operating temperatures. In particular, when the temperature increases due to heat accumulation at the thermal print head, heat control relative the thermal printer heating elements must to take place at 40° C. or higher in order to increase printing resolution and allow for accurate detection. As a result, it was necessary to employ high performance, expensive A/D converters that could provide a large selection of possible binary data values.

More recently is the print controlling apparatus for a thermal printer similar to the type disclosed herein set forth in U.S. Pat. No. 4,912,485, issued Mar. 27, 1990, in the name of the assignee of this application, and is incorporated herein by reference thereto.

It is an object of this invention to eliminate the foregoing problems by providing a thermal printer drive control apparatus that functions at high speed, provides good print quality and has stabilized printing density.

It is another object of this invention to provide simple, low cost A/D converter for the thermal printer drive control apparatus to detect the temperature of the thermal print head and/or the ambient temperature of the thermal print head and control operation at the thermal print head compensate for temperature changes or fluctuations at the thermal print head.

It is a further object of this invention to offer an inexpensive and highly reliable thermal head temperature detection method in which temperature detection can take place accurately by means of improving the thermistor temperature detection circuit without the need for employing a high performance A/D converter, which converter may be a separate component or integrated as part of the CPU, thereby providing for effective cost savings in the design of a thermal printer.

SUMMARY OF THE INVENTION

According to this invention, a thermal printer drive control apparatus for a thermal printer employing a thermal head having a plurality of heating elements comprises memory circuits to record the present and historical drive data of the thermal print head heating elements. Gate circuits are connected to the memory circuits and function to divide up and output the time of the current flow to thermal print head heating elements into multiple secondary current flow intervals that correspond to the primary current flow intervals and the historical drive data to provide an output for the present drive data. Heat sensitive resistive elements are employed in a detection circuit that either detect the temperature of the thermal print head or the temperature of thermal print head heat sinks. A standard value generating circuit employing an A/D converter detects the electrical potential of the voltage divider points between the heat sensitive resistive elements and the resistors of the detection circuit and generates a standard value for the time of current flow to the thermal print head heating elements. Memory means contains a data table for relationships between the standard value and the pulse width of the primary current flow intervals and the pulse width of the secondary current flow intervals. A current flow interval signal generating circuit which, based on the detected results of the standard value, references the data table in the memory means for the purpose of establishing the appropriate current flow intervals at the gate circuits and determining the pulse width of each current flow interval and providing these to the gate circuits as current flow interval signals. A head drive circuit to the thermal print head turns on and off the current flow to the heating elements in response to these gate circuit output signals.

In addition, the thermal printer drive control apparatus of this invention adapted for a serial type thermal printer employes a thermal head having a plurality of heating elements and comprises an A/D converter that detects the electrical potential of the voltage divided points by means of the baseplate material of the thermal head, or by means of the heat sensitive resistive elements that detect the temperature of the head heat sink and by means of these heat sensitive resistive elements and resistors and determines the current flow time to the heating elements employing a relationship recognition means that indicates linearly the relationship between the A/D converter output value and the time intervals for appropriate current flows to the thermal print head heating elements.

Because with the thermal printer drive control apparatus of this invention, the control of the thermal printing is accomplished on-the-fly so that it is not necessary that the CPU perform data processing based on the drive historical method so that high-speed CPU processing accompanied with an increase in the printing speed of the thermal printer can be made possible. In addition, by designing the head control unit connected between the CPU and the thermal print head drive circuits to employ a gate array for holding several lines of data and allocating the operation of the head control unit to be in direct communication with system memory via the CPU memory map, a direct connection is made between the head control unit, via the data bus and the address bus, to the CPU and the system memory. Thus, data to be printed need only be written directly from the CPU directly into the head control unit concurrently with the calculation on-the-fly of head temperature conditions and drive current pulse widths for the head driver circuits, with all of these complicated functions being performed together with a cost effective control means together with an enhancement in printer operating speed.

Interval data signals that have been modulated in cycles can be generated within the CPU as standard signals that generate current flow intervals. One benefit of this invention is that the circuit burden is rendered small even when the historical data to be placed in memory has increased. Moreover, even when varying the current flow interval and changing the preheat pulse width due to printer parameters, such as, printing mode, the type of printing media and the type of ink ribbon employed, the CPU will determine the type of printing mode and determine the current flow interval from the function of the thermal printer drive control apparatus and the data tables placed in the system memory. Because only a conversion process is involved, it is possible to establish the optimal current flow time for the numerous printing modes by means of a very simple method comprising this invention.

Further, it is possible to calculate the pulse width at very high speed by determining the relationship between the output value of the A/D converter and the ratio of the heating element current flow time or the pulse width based on table data placed in the system memory. In this connection, linear approximation is possible and that the calculation speed will be enhanced. Also, employing a method of determining values with a function contributes to a reduction in the capacity of the ROM because it is not necessary to store such a data table within the ROM.

By detecting the A/D converter output values and calculating the current flow time from functions and data tables, the temperature of the thermal print head is essentially being detected in real time, i.e., on-the-fly, thereby rendering highly accurate heat control of the thermal print head heating elements.

Furthermore, by including some relatively simple additional circuitry, it is possible to employ the same A/D converter to provide very useful functions that will allow the user to adjust for a preferred density. By utilizing a density adjustment method to change the pulse width rather than a heating element voltage changing method, the overall product will be safer for use and simpler in design. In addition, even if variable resistance device in the detection circuit is damaged, the elimination of calculated abnormal pulse width values when calculating the pulse widths is possible. Also, the density adjustment method of this invention may be use in a variety of different types of thermal printers employing heating elements to print.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 11 is an optimal printing density characteristics diagram that shows the relationship between thermal printer standard pulse width, TW, and thermistor temperature, T, that allows for optimized printing density to be achieved.

FIG. 12 is a characteristics diagram that shows the relationship between the ratio of the standard pulse width that provides for optimal printing density and the output values of the A/D converter.

FIG. 13 is a schematic circuit diagram of a standard value generating circuit for utilization with this invention.

FIG. 14 is a schematic circuit diagram of a thermistor temperature detection circuit connected to a linearized thermistor circuit.

FIG. 15 is a graphic illustration that shows the relational characteristics between the electrical potential of voltage divider point, $V_p$, of the circuit in FIG. 14 and the thermistor temperature.

FIG. 17 is an explanatory diagram that shows the resistance of the density adjustment volume of the thermal printer drive control apparatus of FIG. 16 and the density correction values.

FIG. 20 is an explanatory diagram of an example of the initial data table within the memory system utilized in this invention and shows the relationship between the A/D converter output code and the standard pulse width of the current flow time of the thermal printer drive control apparatus.

DESCRIPTION OF THE PREFERRED EMBODIMENTS

Figure 1:
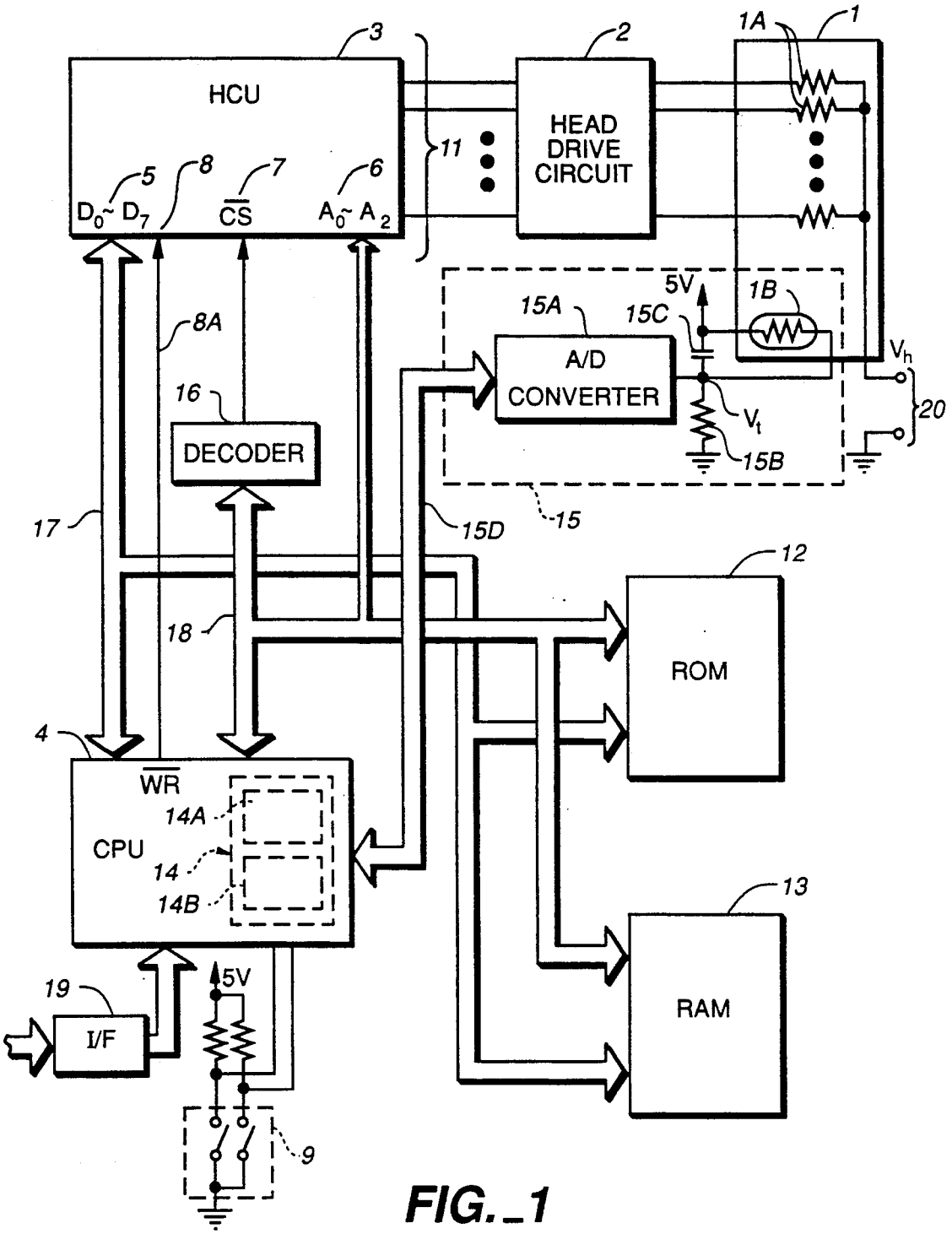
FIG. 1 is a partial circuit diagram for a thermal printer employing a first embodiment of the thermal printer drive control apparatus of this invention.

Reference is now made to FIG. 1 wherein there is shown a portion of a thermal printer control circuit that employs the first embodiment of the drive control apparatus of this invention. As shown in FIG. 1, thermal print head 1 is provided with multiple heating elements 1A which are driven by head drive circuit 2. Thermal print head receives operating voltage, $V_h$, at power supply input 20 for the purpose of operating heating elements 1A. Head control unit (HCU) 3 is a unit circuit which functions as a CPU peripheral, and is connected between CPU 4 thermal print head 1. HCU 3 controls the amount of heat developed by each heating element 1A to produce a dot or other such image on a thermal recording medium by controlling the pulse width of drive pulses applied by circuit 2. CPU 4 receives printing data input for printing at thermal print head 1 via I/F interface 19. Interface 19 also may be employed to indicate the printing mode. In CPU 4, there are timer circuits 14 having at least two independently operated timer units 14A and 14B.

Figure 2:
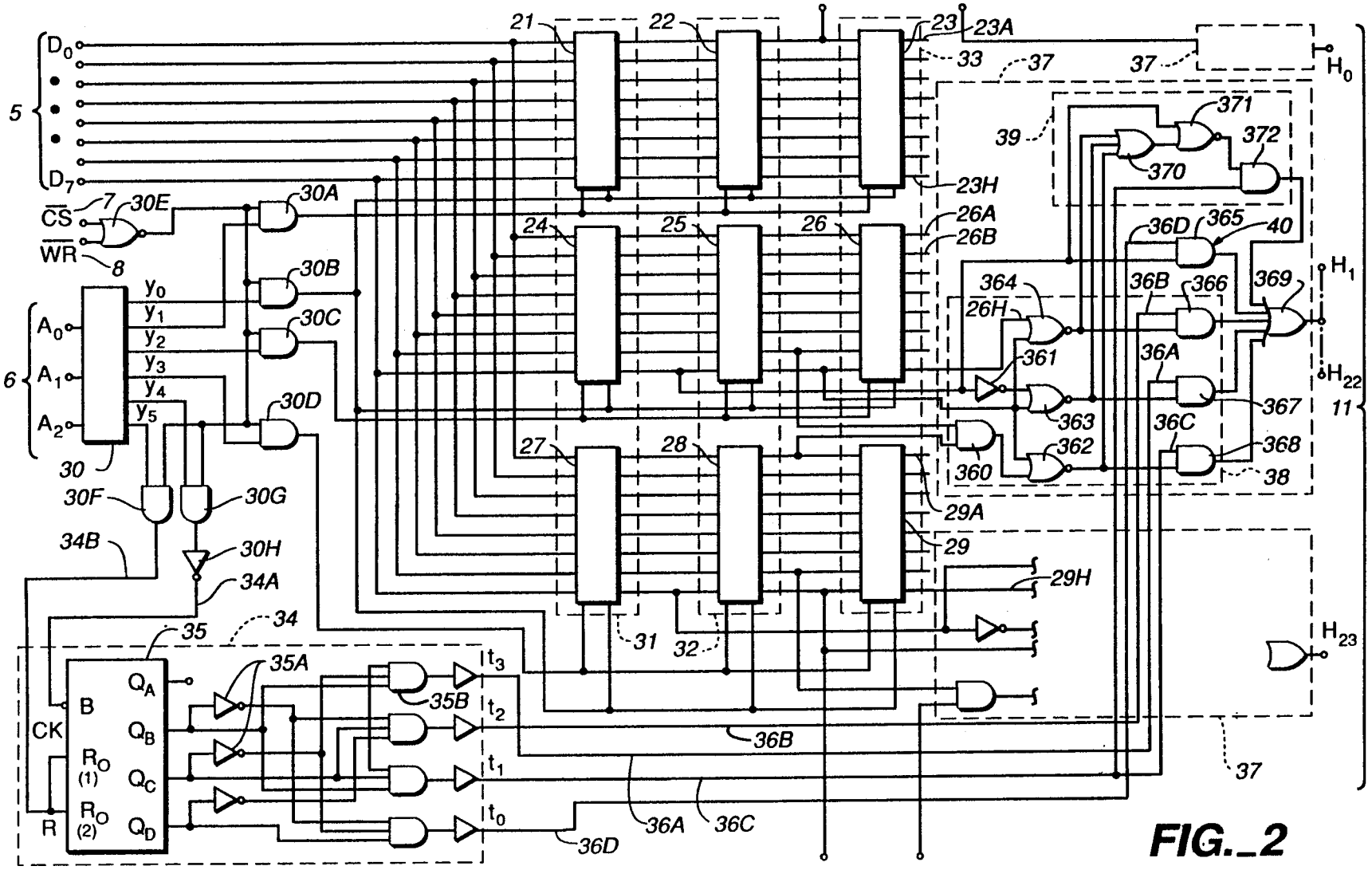
FIG. 2 is a detailed schematic circuit diagram of the head control circuit for the drive control apparatus of this invention.

HCU 3 is connected to CPU 4, such as an 8-bit CPU, via data bus 17, address bus 18 via decoder 16 and write/read ($\overline{WR}$) control line 8A. HCU 3 is allocated a special address on the CPU memory map, which is the same for ROM 12 and RAM 13. The ($\overline{WR}$) signal functions as a data strobe signal for sequentially writing data into latch circuit groups 31, 32 and 33 in HCU 3 (FIG. 2). Also, data bus 17 and address bus 18 are connected to ROM 12 and RAM 13. ROM 12 stores a print control program, a character font generator, certain conversion tables, e.g., table 77 in FIG. 7, relative to printing parameters, in particular, the print mode and type of various types of thermal printers. Decoder 16 is connected to $\overline{CS}$ (Chip Selection) input 7 of HCU 3 for the purpose of accessing the unit circuit. Terminal 7 provides a means for determining for circuit selection in accordance with predetermined address data from ROM 12 provided by CPU 4 on Address bus 18. Data input 5 of HCU 3 is connected to data bus 17 to receive 8-bit data input A0–A7 and address input 6 of HCU 3 receives an input comprising the least significant three bits (A0–A2) via address bus 18. Obviously, there are other commonly known and used conventionally generated control signals generated under the control of CPU 4 but they are not relevant to the disclosure of this invention and, therefore, have been omitted for the purpose of simplification.

A standard value generating circuit 15 is connected between CPU 4 and thermal print head 1 and functions to generate the standard value of the current flow time for heating elements 1A based upon their operating temperature conditions. Included in the major components in circuit 15 are A/D converter 15A, coupled by 8-bit data bus 15D to CPU 4, and thermistor 1B, which is a heat sensitive resistive element, and functions to detect the current temperature of thermal print head 1. Thermistor 1B is mounted on thermal print head 1 for detecting the temperature of the base material 1D or the heat sink 10 of head 1 (FIG. 10), either of which is representative of head temperature. A divider circuit comprising capacitor 15C and resistor 15B detects an electrical potential, $V_t$, between thermistor 1B and resistor 15B and A/D converter 15A converts this linear potential value into a digital signal and generates binary codes in cyclic operation with commands received from CPU 4. Capacitor 15C, connected in parallel with thermistor 1B to the power supply, provides isolation and stabilizes the output potential, $V_t$, in order that accurate detection of this potential can be accomplished, A/D converter 15A provides, for example, an 8-bit binary code output. A/D converter 15A converts electrical potential, $V_t$, into a digital 8-bit code and provides this data on data bus 15D to CPU 4. The number represented by this 8-bit code can represent 255 different temperature steps or values.

Printing mode detection circuit 9 detects printing parameters, such as, the type or mode of printing, e.g., thermal paper printing or thermal transfer printing, or a color ribbon or a monochrome ribbon, etc. Such mode detection may also be provided through the software from printer interface 19. In general, such things as the type of ink ribbon and whether the mode is the thermal paper printing mode or not are detected via an electrical switch provided in the location that contains the cartridge that holds the ink ribbon.

Figure 10:
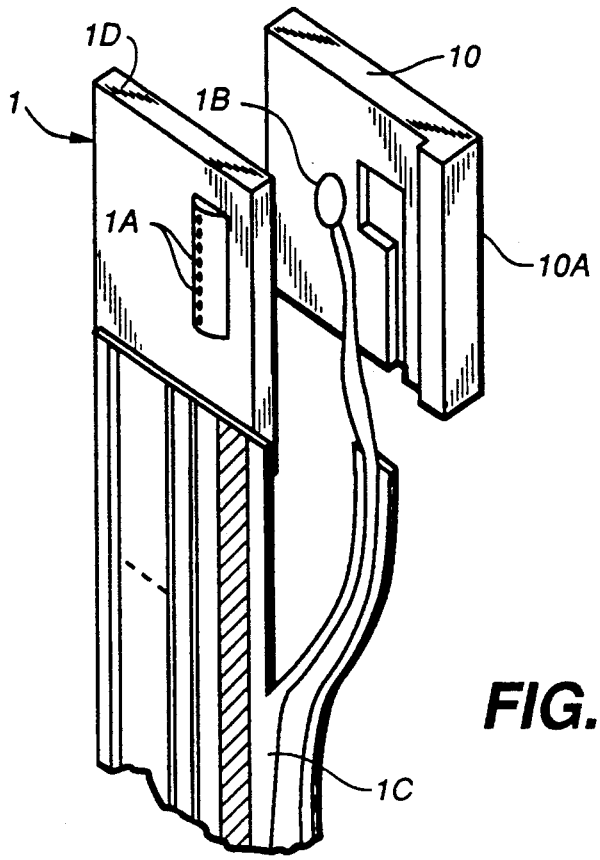
FIG. 10 is a partial view of one type of serial-type thermal print head applicable for use with this invention.

FIG. 10 is a partial perspective view of one type of serial thermal print head 1 that may be employed relative to this invention, although the practice of this invention is not limited to this particular type of head. Serial type thermal printers comprise an aligned column or row of heating elements 1A for thermally printing a line of dots at each printing position. In the example here, the aligned heating elements 1A include 24 dots driven from output terminals, HO-H23 of HCU 3. Thermal head 1 is moved to the next consecutive printing position where aligned column of dots is printed and this process is repeated until a full line of data has been completed, after which the recording medium is advanced and this printing process is repeated and continued.

Thermal head chip 1 contains a series of heating elements 1A formed on a suitable base ceramic material 1D. Thermal print head chip 1 is attached to heat sink 10, and a grooved section 10A is formed in heat sink 10 directly behind or beneath heating elements 1A. A heat sensitive means in the form, for example, of a heat sensitive resistive element, such as, thermistor 1B, is secured to the back of thermal print head 1 in grooved section 10A with an adhesive that has good heat conductivity characteristics. Flexible printed cable (FPC) 1C provides for connection between electrodes of heating elements 1A and head drive circuit 2 and between thermistor 1B and standard value generating circuit 5.

FIG. 2 is a detailed schematic circuit of HCU 3. For the purpose of this example, the head drive output 11 from HCU 3 may comprise 24 output pins, H0 to H23, to drive a 24-dot thermal print head. 8-bit printing data, D0 to D7, is provided as input via data bus 5 to data latch circuits 21, 24 and 27. Latch circuits 21–23 latch in the head drive signal data for H0 to H7. Latch circuits 24–26 latch in the data for H8 to H15. Latch circuits 27–29 latch in the data for H16 to H23. A first latch circuit group or data buffers 31 will contain one dot row of current head data relative to the current print data row. A second latch circuit group or data buffers 32 will contain one dot row of previously received printing data from the immediately previous print data row. A third latch circuit group or data buffers 33 will contain one dot row of previously received data from two previous print data row.

Address decoder 30 (National Semiconductor Corporation chip No. DM54LS138) in FIG. 2 functions to allocate and store each 8-bits of printing data via data lines marked D0–D7 according to the three binary select input, address data from CPU 4 and, further, maintains a current flow interval data signal that provides the current flow time for heating elements 1A of thermal print head 1. As an example, data latch circuits 21, 24 and 27 may be selected according to the least significant three bits, $A_0$, $A_1$ and $A_2$, of bit data from address data on data bus 18 and timed by the $\overline{CS}$ and $\overline{WR}$ cyclic signals from CPU 4 to AND gates 30A–30D and NOR gate 30E, data is sent in groups of three for a 24 dot head so that dots H0–H7 are first sent, followed by dots H8–H15 and then dots H16–H23 to complete a line of data, H0–H24. However, it should be noted that with a 32 bit CPU 4, 24 bit data could be presented in parallel to latch group 31 via a 16-bit wide data bus 17. Also, these two signals are provided as an input to AND gates 30F and 30G, the respective outputs of which are provided to the clock (CLK), via inverter 30H, and reset (R) inputs of counter 35 in current flow interval pulse generating circuit 34. The other inputs of AND gates 30B, 30A, 30C, 30D, 30G and 30F are respectively connected to outputs $Y_0$–$Y_5$ of decoder 30. Thus, when a specific address is selected employing a three bit ($A_0$, $A_1$, $A_2$) address with signals $\overline{CS}$ and $\overline{WR}$, one of the conditions at outputs $Y_0$–$Y_5$ of decoder 30 is changed to a different binary signal level, as indicated relative to FIG. 3, so that CPU 4 is able to control the timing and latching of data through latch circuit groups 31, 32 and 33 as well as operation of current flow interval pulse generating circuit 34 in producing timed intervals, $t_0$, $t_1$, $t_2$, and $t_3$, between cyclic signals $\overline{CS}$ and $\overline{WR}$ from CPU 4 wherein the timing signals are generated via timer 14, as per the description in connection with FIG. 9 later on.

At the same time that head drive printing data is provided as output onto data bus 17 from CPU 4, $\overline{WR}$ signal is provided as output on line 8A and the $\overline{CS}$ signal is accessed according to address data which is prestored in a memory map. The data is then transferred to each of the data latch circuits 21, 24 and 27, according to the three bit binary address data on address bus 18. When this occurs, data that has already been stored in respective latch circuit groups 31, 32 and 33 is shifted to the right in FIG. 2. For example, if data is read into data latch circuit 21, the previous data stored in latch circuit 21 shifts to data latch circuit 22 and is held as previous data while the data previously stored in latch circuit 22 shifts to data latch circuit 23 and is held as previous data from the previous two data rows. In this way, the present print data is always stored in data latch circuit 21, the immediately previous print data is stored in data latch circuit 22, and the second previous print data is stored in data latch circuit 23. The shifting of data is synchronously controlled from the outputs of AND gates 30A–30D. Employing the binary addresses $A_0$–$A_2$, several different such latch groups or buffers 31–33 are possible as well as the provision for clock (CLK) and reset (R) signals to circuit 34, as will be explained in further detail later relative to FIG. 3. Thus, as the number heating elements 1A increases in head 1, the number of address bits necessary to achieve synchronous supply of data will also increase to select corresponding data latch circuits relative to the storage of present data.

Figures 3, 4:
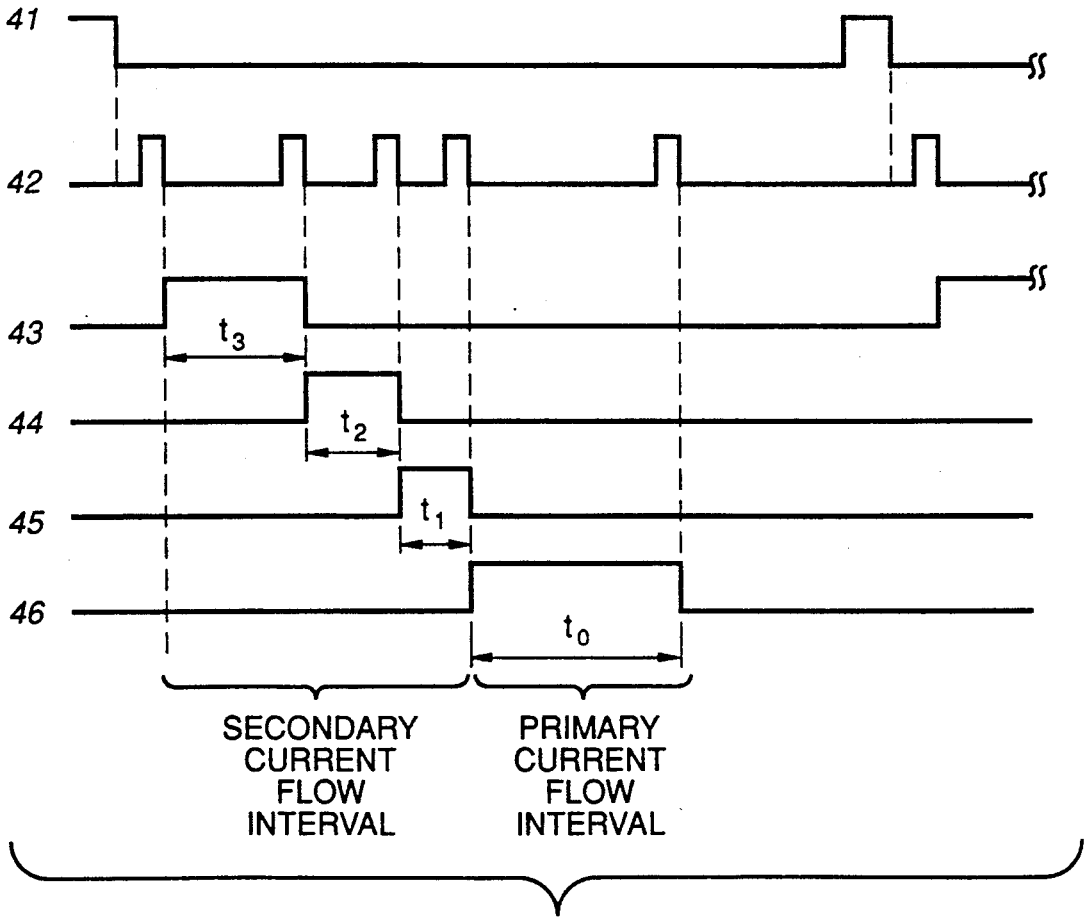
FIG. 3 is an explanatory diagram illustrating the address data for the head control circuit and the related functions.
FIG. 4 is a waveform diagram showing the input waveforms of the current flow interval pulse generating circuit of the drive control apparatus of this invention.

Current flow interval pulse generating circuit 34 demodulates interval data signals that have been modulated relative to the cyclical signals $\overline{CS}$ and $\overline{WR}$ from CPU 4, and selectively removes these signals, and creates current flow interval pulses, $t_0$, $t_1$, $t_2$, and $t_3$. Circuit 34 comprises binary counter 35 having three of its Q outputs connected to AND circuits 35B via inverters 35A. Binary counter 35 has two inputs from decoder 30, clock input 34A and reset input 34B. The clock input comprises pulse signals that are transferred and sent in variable cycles. The four outputs from circuit 34 comprise current flow intervals or interval signals $t_0$, $t_1$, $t_2$, and $t_3$, which are shown in FIG. 4. Interval $t_1$ is the primary current flow interval that corresponds to the current drive printing data and intervals $t_1$, $t_2$, and $t_3$ are secondary current flow intervals that correspond to the historical drive printing data.

HCU 3 comprises thermal transfer controlling means in synchronous operation with data latch timing. Gate circuits 37 are connected to the outputs of latch circuit groups 31, 32 and 33, and with energizing intervals or interval signals from circuit 34 to provide head drive signals H0–H23 for heating elements 1A each having predetermined times. The output signals of current flow standard value generating circuit 34 are connected via lines 36A, 36B, 36C and 36D to each of the gate circuits 37, although connection relative to only one gate circuit is illustrated for the purpose of simplicity. Circuits 37 combined current flow intervals or interval signals $t_0$, $t_1$, $t_2$, and $t_3$ to drive printing data from data buffers 33 to produce head drive signals, H0–H23, to head circuit 2 having data pulse widths based upon thermal operating conditions at thermal print head 1. Each gate circuit 37 is composed of a first gate circuit 38 for past drive data, a second gate circuit 40 for current drive data, and a third gate circuit 39 for the purpose of providing an additional preheating pulse, based upon drive history. Current flow intervals $t_1$, $t_2$ and $t_3$ are inputs to first gate circuit 38. Current flow interval $t_0$ is an input to second gate circuit 40. Secondary current flow intervals $t_1$ is also an input to third gate circuit 39 for the purpose of creating a preheating pulse. Thus, current flow intervals $t_0$, $t_1$, $t_2$, and $t_3$ are applied relative to print data based upon historical drive data in the form of previous print data connected to gate circuits 37 as well as present print data.

As indicated above, a plurality of gate circuits 37 are employed for providing outputs H0–H23, one for each output. Thus, there are twenty-four such circuits 37 in this embodiment and only one is shown in detail in FIG. 2 relative to output 26H from data latch circuit 26 for producing output signal, H15. Each gate circuit 37 is composed of a first gate circuit 38, which corresponds to the past drive data, a second gate circuit 40, which corresponds to the current drive data, and a third gate circuit 39, which adds an additional preheating pulse, based upon historical data drive. The first group of eight gate circuits 37, therefore would be respectively connected to receive the outputs 23A–23H from data latch circuit 23, the second group eight gate circuits 37 would be respectively connected to receive the outputs 26A–26H from data latch circuit 26, and the third group of eight gate circuits 37 would be respectively connected to receive the outputs 23A–23H from data latch circuit 23.

Gate circuits 37 each comprise an AND gate 360, inverter 361, NOR gates 362, 363, 364, AND gates 365, 366, 367, 368 and OR gate 369. As indicated above, the detailed gate shown is for output H15. The present print data corresponding to dot H15 is provided as input to inverter 361 and one of the inputs of AND gate 365. AND gate 365 is gate circuit 40 for the output for current drive data. The inverted present dot H15 print data is then provided as an input to one input of each NOR gate 362, 363 and 364. The immediately previous print data from data latch circuit 25 for dot H15 is the other input to NOR gate 363. The immediately previous print data for adjacent dots from respective data latch circuits 25 and 28 for H14 and H16 are input to AND gate 360. The output of gate 360 is the other input to NOR gate 362. The second previous print data output for dot 15 on output line 26H is the other input to NOR gate 364. The outputs of the respective NOR gates 364, 363 and 362 are inputs to AND gates 366, 367 and 368. The other inputs to AND gates 366, 367 and 368 are, respectively, intervals or energizing interval signals t2, t3 and t1. relative to past drive data. The other input to AND gate 365 is interval or energizing interval signal to relative to current drive data. The output of these four AND gates 365–368 are inputs to OR gate 369 and the output of OR gate 369 is the output driving signal H15 to head drive circuit 2.

The present data output from latch 24 for dot H15 is also connected NOR gate 371. Also, each of the outputs of NOR gates 362, 363 and 364 are connected as inputs to OR gate 370, the output of which is connected to the other input on NOR gate 371. The output of NOR gate 371 is connected to AND gate 372 which is another input to OR gate 369. This circuit of gates 370, 371 and 372 is the preheat gate circuit 39 that provides a preheat pulse to selected heating elements 1A wherein there has been no current printing activity.

FIG. 3 illustrates the correspondence between the address data, A0–A2, to HCU 3 via input 6 and the resulting functions that take place based upon address values. When A2=0, it is possible to selectively access the data latch circuit group 31 via the data of the least significant two bits. After the data have been set into latch groups 31–33, address values for A2=1 are set, the designated addresses are accessed and pulses to current flow signal inputs 34A and 34B are applied so that current flow pulses for heating elements 1A can be provided.

FIG. 4 is a timing diagram of the input/output waveforms relative to current flow standard value generating circuit 34. Input waveform 41 is the interrupt input from timer 14 in CPU 4 that determines the printing cycle and is based upon the $\overline{WR}$. In general, the internal interrupt function is implemented using a timer built into CPU 4. Input waveform 42 is clock input 34A from decoder 30 and is based upon the $\overline{CS}$ signal. The printing cycle sequentially changes for clock input signal 42. After reset via input 34B to binary counter 35, clock input 34A is received at input 34A and is converted into a 4-bit code by counter 35. This code is then converted into a plurality of output waveforms 43–46 by means of inverters 35A and AND circuits 35B. Output waveform 43 is output 36A of circuit 34; output waveform 44 is output 36B of circuit 34; output waveform 45 is output 36C of circuit 34; and output waveform 46 is output 36D of circuit 34, with respective pulse widths $t_3$, $t_2$, $t_1$ and $t_0$. These pulse widths $t_3$, $t_2$, $t_1$ and $t_0$ become the current flow times for current drive pulses applied to heating elements 1A via head drive circuit 2 and correspond to the drive histories of heating elements 1A.

Figure 5:
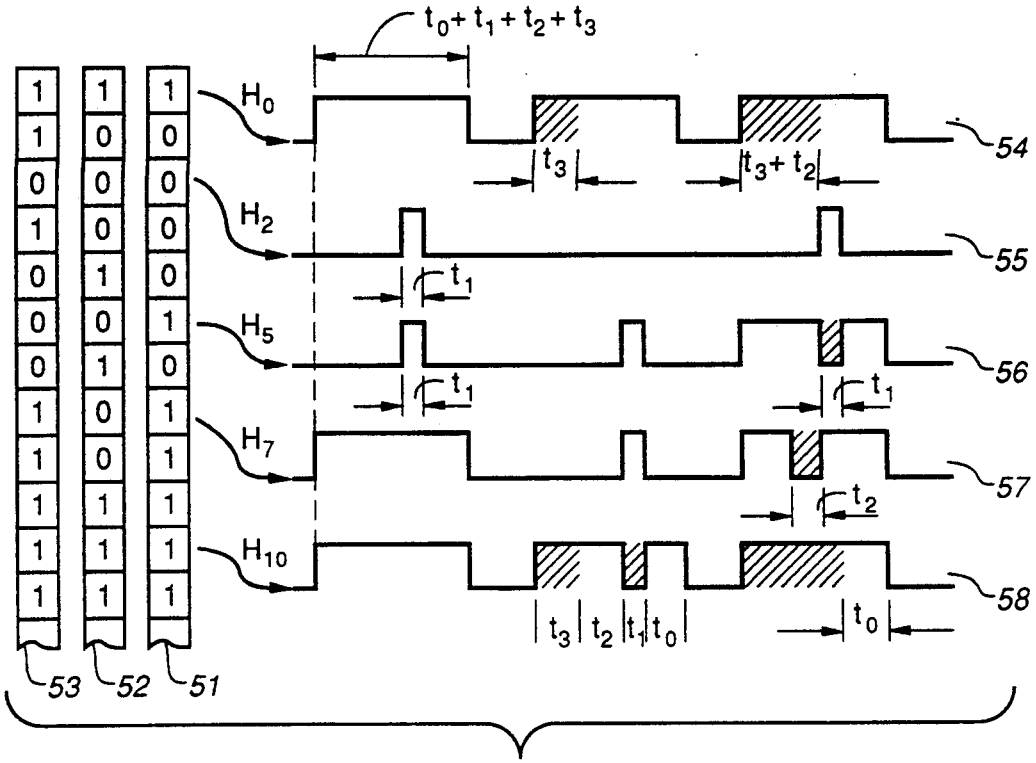
FIG. 5 is a waveform diagram for the purpose of explaining the method of current flow to the thermal print head of the drive control apparatus of this invention.

FIG. 5 illustrates the method employed for providing current driving pulses to thermal print head 1. Lines of binary printing data are indicated at 51, 52 and 53 stored in data latch circuits 31, 32 and 33, respectively. Data 51 indicates current data in a current data row, while data 52 indicates data from the immediately previous data row, and data 53 indicates data from two previous data rows. Only three consecutive rows of twelve data dots out of a total of twenty-four is shown for purposes of simplification. Waveforms 54–58 are, therefore, representative output waveforms of a few of head drive signals, H0–H23. Waveform 54 represents the waveform for H0, waveform 55 represents the waveform for H2, waveform 56 represents the waveform for H5, waveform 57 represents the waveform for H7 and waveform 58 represents the waveform for H10. In the case of each waveform 54–58, current flow interval operation is shown for three timings or print cycles based upon the binary printing data 51, 52 and 53. In the case of drive signal H0, no previous printing has recently occurred so that the current flow interval is a combination of all intervals $t_3$, $t_2$, $t_1$ and $t_0$. The same interval combination and application is also true for drive signals H7 and H10 except that these intervals were based upon previous historical data relating to previous print conditions at thermal print head 1. Thus, the current flow intervals that are subsequently applied will not be the same in every case. For example, waveform 54 represents data when printing first commences. At the commencement of current flow to thermal printing elements 1A for the "current-flow-ON" dots, the total current flow time in which current flows through heating elements 1A will be a total of all current flow intervals $t_3$, $t_2$, $t_1$ and $t_0$. For the "current-flow-OFF" dots, the $t_1$ interval will be provided as a preheating pulse, as illustrated in both waveforms 55 and 56. This preheating pulse, $t_1$, is limited to increasing the temperature of the baseplate material ID of thermal print head 1 and is not sufficient in magnitude to form dots onto the recording medium via the printing elements 1A.

As shown in output waveform 54, when the current flow data of the heating element is ON during a preceding timing or print cycle, current flow interval $t_3$ will be eliminated, as indicated by the diagonal cross-hatch area in the second interval for waveform 54. When there is drive printing data during the course of one of two preceding timings or print cycles, current flow interval $t_2$ will be eliminated, as indicated by the diagonal cross-hatch area in the third interval for waveform 57. When there is drive printing data during the course of the two preceding timings or print cycles, both current flow intervals, $t_3+t_2$, will be eliminated, as indicated by the diagonal cross-hatch area in the third interval for waveform 54. When two neighboring dots have current flow ON due to the previous drive results, such as H7 relative to H8, current flow interval $t_1$ will be eliminated, as indicated by the diagonal cross-hatch area in the third interval for waveform 56. When all of the data that is to be eliminated and compared is ON data and the current data is also ON, only current flow interval $t_0$ will be provided, as indicated in the third interval for waveform 58. Conversely, when the data that is to be eliminated and compared is OFF data and the current data is OFF, a preheating pulse, $t_1$, will be provided, as indicated in the first and third intervals for the waveform 55. The comparison of drive data and the selection of the current flow interval are performed by gate circuits 37.

A thermal printer of simple arrangement can be realized by using a gate array and the utilization of a single-chip, head control circuit. This is not only an important factor for the terminal printers that employ thermal printing techniques, but also is a very important factor for incorporating thermal printer engines into compact size, oriented equipment, such as, portable word processors.

In the foregoing example, past data was indicated employing two preceding historical drive data events placed in memory. However, in the case of three or four preceding historical drive data events, it is possible to increase the number of current flow intervals to four or five. In this manner, it is possible to realize even more detailed control of the thermal printing operation by increasing the number of possible current flow intervals with increased storage of consecutive rows of previous print data. This higher number of handled historical drive data events provides for higher speed printing and higher quality printer output.

Figure 6:
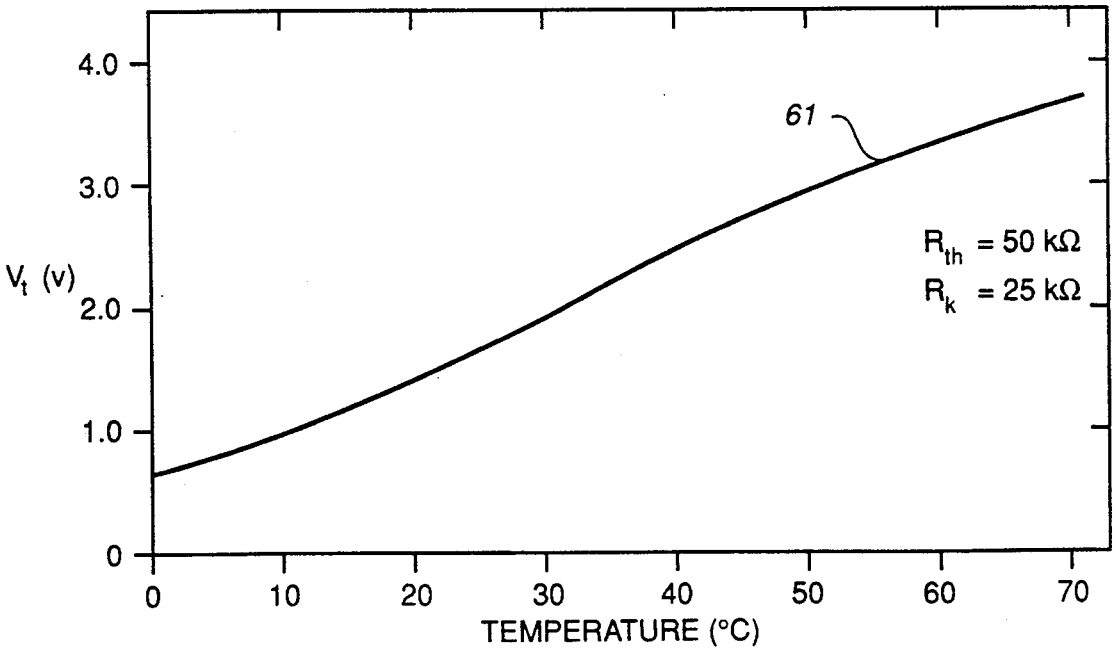
FIG. 6 is a graphic illustration that shows the relational characteristics between standard value, thermistor temperature and the voltage divider point electrical potential, $V_t$, of the thermal printer drive control apparatus.

FIG. 6 is a graph that shows the relationship between the thermistor 1B temperature, obtained via standard value generating circuit 15 and the voltage potential, $V_t$, of the voltage divider point in standard value generating circuit 15. As an example, characteristic curve 61 is shown when the 25° C. standard value of the thermistor is $R_{th}$ and $R_{th}=50$ kilohms and when the resistance of resistor 15B is $R_k=25$ kilohms. Because characteristic curve 61 is non-linear, the temperature range will vary slightly at each voltage interval. However, in CPU 4, the thermal print head temperature will be detected by detecting this electrical potential, $V_t$, through the binary code provided on data bus 15D by A/D converter 15A. As a result, this will make it possible to set up optimal current flow conditions according to the printing conditions, such as, for example, the printing mode and ribbon type.

Figures 7, 8, 9:
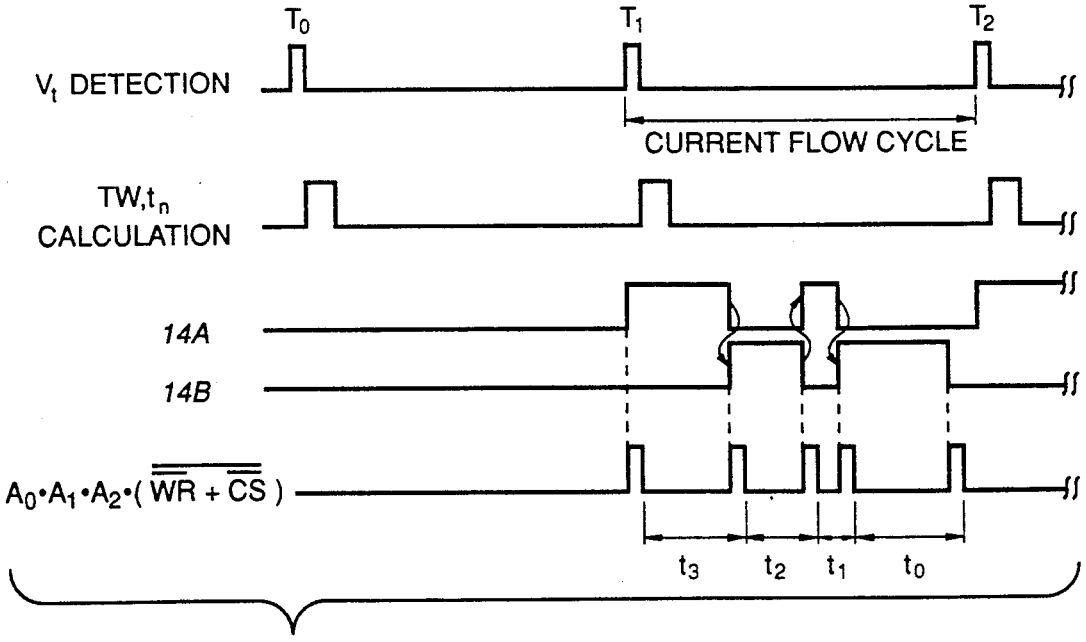
FIG. 7 is an explanatory diagram that shows the mutual relationship between drive control apparatus output value, $V_t$, the A/D converter output value and the current flow time standard pulse width.
FIG. 8 is an explanatory diagram that shows one example of the current flow interval ratios of the drive control apparatus.
FIG. 9 is a waveform diagram that shows the timing relationship during the driving of the head.

FIG. 7 sets forth the details of a first data table, portions of which are stored within ROM 12, and shows the mutual relationship between the A/D converter output code of the thermal printer drive control apparatus of this invention and the standard pulse widths, TW, relative to current flow times. The data table comprises thermistor temperature table 71, $V_t$ output value table 72, and A/D converter output values, i.e., standard output code value table 73 and standard pulse width ratio table 74, together with standard pulse width table 75 and the standard pulse width stipulated value 76. Table 73 is written in hexadecimal code. However, within ROM 12, table 73 is recorded in binary code. The relationship between table 73 and table 74 and the stipulated value 76 of the standard pulse widths are all stored as a primary table 77 within ROM 12. Tables 72 and 71 are respectively examples of $V_t$ output values dependent upon corresponding thermistor temperature values. Pulse width values, TW, illustrated in standard pulse width table 75 are different for each different printing mode, and are calculated pulse widths determined by CPU 4. The calculated value is based upon hexadecimal code output of A/D converter 15A, the stored ratio value relative to table 77 in ROM 12 and the stipulated value 76. As a result, CPU 4 can set the standard pulse width by knowing the standard pulse width ratio in Table 77 for given printing parameters, e.g., a given printing mode. Standard pulse width, TW, is calculated from stipulated value 76 of the standard pulse width and the determined standard pulse width ratio 74. The standard value 1.00 of the pulse width ratio employs 25° C. as a standard reference point. Thus, by determination from table 77, the standard pulse width ratio, the standard pulse widths at 25° C. for a given printing mode can be determined for each selected printing mode.

For further accuracy in the use of this table, the temperature steps of 10° C. units have actually been subdivided further so that code table 73 and standard pulse width ratio table 74 are, in fact, held as data in 1° C. units. However, it is noted that it is also possible to hold these values in 10° C. units and linearly approximate the 1° C. unit values in between the 10° C. units.

Based on experiments, the characteristics of the ratio of the standard pulse width can be optimized by matching them with the heat accumulation characteristics of printer thermal print head 1. Normally, it is very difficult to match the circuit characteristics to these optimal characteristics in a system that employs a pulse generating circuit that has saturated the thermistor. However, in a system that employs an A/D converter, it is known that the temperature characteristics curve can be freely selected.

FIG. 8 illustrates an example of a second data table within ROM 12 that retains information relating to the current flow interval ratio applicable relative to a given printing mode and set forth the standard values, TW, relative to a selected printing mode. Printing modes 81, 82 and 83 are, respectively, for thermal transfer one time media, thermal transfer multiple times media, and thermal media. Current flow ratios 84, 85 and 86 for each of these respective modes is shown for current flow intervals $t_3$, $t_2$, $t_1$ and $t_0$. The current flow interval ratio represents the one-time thermal transfer interval, $t_0$, with the value 100 as the standard pulse width. As previously indicated, the pulse width ratio is varied according to the printing mode, such as the type of ink ribbon or the type of printing media employed. In accordance with the printing mode, the pulse widths of each of the current flow intervals can be easily found from the output values of standard value generating circuit 15 in relation with the values of the first data table and the second data table in ROM 12. The standard pulse width, TW, is determined from the first table of FIG. 7, stored in memory, relative to obtaining a standard pulse width ratio (relative to a selected printing mode) based upon the standard value from A/D converter 15A. Then, the current flow intervals $t_3$, $t_2$, $t_1$ and $t_0$ are determined from the second table in FIG. 8 based upon the selected printing mode and ratios determined from the second table multiplied with the determined standard pulse width, TW. This determination can be based upon a ratios of individual current flow intervals relative to one of the current flow intervals or based upon ratios of individual current flow intervals relative to the total of all current flow intervals. As an example of the first case, in the case of print mode selection, "THERMAL TRANSFER ONE TIME", the current flow interval, $t_3$, can be obtained by calculating the equation $t_3 = t_3(\text{In FIG. 8}) \cdot TW / t_0(\text{In FIG. 8}) = 80 \cdot TW/100$. In this manner, the standard pulse width, TW, can be a value determined as one of the $t_0$ values from the table in FIG. 8. As an example of the second case, in the case of print mode selection, "THERMAL TRANSFER ONE TIME", the current flow interval, $t_3$, can be obtained by calculating the equation $t_3 = t_3(\text{In FIG. 8})/(t_3+t_2+t_1+t_0)$ (In FIG. 8)$\cdot TW = 80/240 \cdot TW$.

The printing modes are not limited to those exemplified above. The combinations are numerous relative, for example, monochrome ink ribbon, color ribbon and printing speed, printing media, etc.

Reference is now made to FIG. 9 in order to describe an example of the operation the head drive timing of the thermal printer drive control apparatus of this invention. $T_0$, $T_1$ and $T_2$ in FIG. 9 indicate current flow cycles and are established by timer 14 employed to determine the current flow cycles which correspond to one print cycle. In addition to the current flow cycles, timer 14 also provides the basic clock of the stepper motor (not shown) that transversely moves thermal printer head 1 of a serial type printer.

CPU 4 accesses standard value generating circuit 15 in cyclic operation with the current flow cycles and detects a derived 8-bit output code (standard value) of A/D converter 15A. CPU 4 then references the first data table in ROM 12 and calculates the standard pulse width, TW, which is based on the temperature conditions at thermal print head 1 (standard value) and selected printing parameters. CPU 4 then references the second data table in ROM 12 and calculates each current flow interval, $t_0$, $t_1$ . . . $t_n$, based upon selected printing parameters. At the next timing cycle, CPU 4 will alternately employ its timer circuits 14A and 14B and synchronize to alternating output times provided to HCU 3, i.e., count both the pulse width values of the primary current flow intervals and secondary current flow intervals to heating elements 1A that match the current flow intervals, and outputs these values as cycle signals by accessing the specified addresses, A0–A2, to HCU 3. For example, after $t_3$ is set in timer circuit 14A, $t_2$ will be set into timer circuit 14B while timer 14A is in operation. When the count operation for $t_3$ in timer circuit 14A has terminated, timer 14B will commence operation and $t_1$ will concurrently be set into timer circuit 14B. By alternately employing a pair of timer circuits in this manner, highly accurate time can be obtained and accurate current flow control is possible without affecting CPU processing speed. In addition, the processing of the timer outputs employes the CPU internal interrupt function so that delay time is minimized. CPU 4, which is provided with a plurality of timer circuits, therefore, doubles as a current flow interval data output device. The reading of pulse width, TW, takes place at each designated cycle of the head drive, and is able to prevent heat accumulation and bring about excellent print quality by rendering the pulse width, TW, to correspond to the current thermal print head temperature, which is in continuous change. While the built in timers 14 of the CPU 4 may be utilized as indicated above, it is also acceptable to provide separate timers for this function external of CPU 4.

During the printing operation, the pulse width can be set to the optimal value at the time by basically operating A/D converter 15A at one-dot cycles and detecting the temperature of thermal print head 1. However, in the slow, low-speed print mode, this is not necessary in one-dot cycles because the rise in the temperature of thermal print head 1 is not a sharp or acute temperature rise. In addition, CPU 4 reads the data tables in ROM 12 that correspond to the designated print modes and converts these into cycle signals and outputs them so that the widths of the total current flow time and the current flow intervals are varied relative to temperature changes at thermal print head 1, and the current flow signals are provided as output in accordance with printing mode selection parameters.

Reference is now made to FIGS. 11–15 relative to a second embodiment of the thermal printer drive control apparatus comprising this invention. In this second embodiment, the standard pulse width, TW, obtained from A/D convert 15A is employed as a pulse width which designates the total current flow time. Further, in the first embodiment, a stored table 77 is maintained for discrete values of A/D converter output and associated standard pulse width ratios from which CPU 4 may calculate the standard pulse width, TW. In the second embodiment, such discrete values are not stored but rather a function, which may be either an equation stored in memory employing an interpreter, for example, to convert the equation into calculated values or may be under the control of a computer program stored in ROM 12 and executed by CPU 4 to determine calculated values, is employed to calculate standard pulse widths relative to detected A/D converter output values. The former of these two approaches of calculation is illustrated in this embodiment and will be more appreciated from the following description.

Figure 11:
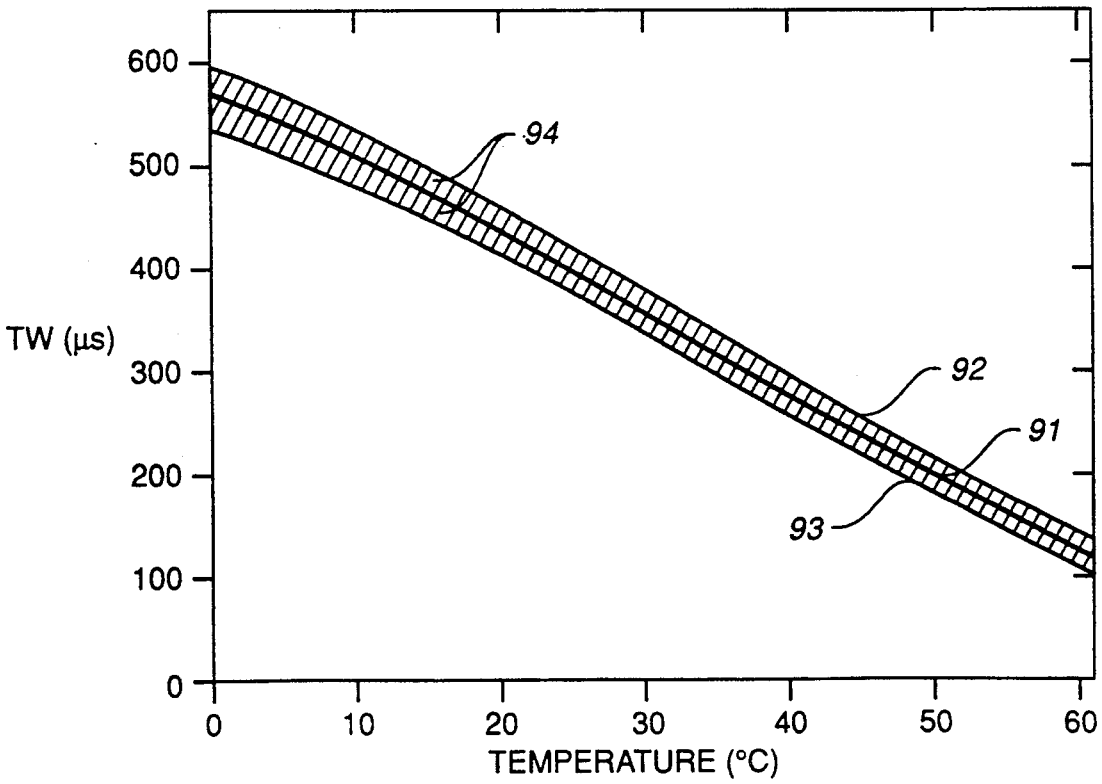
FIGS. 11–15 relate to a second embodiment of the thermal printer drive control apparatus of this invention.

FIG. 11 is a graph of the optimized printing density characteristics (1) when the pulse width is the total of the primary current flow intervals of the thermal printer drive control apparatus of this invention, as earlier described, (2) when all of the secondary current flow intervals are standard pulse width, TW, and (3) when a serial type thermal print head is employed as the thermal printer. In particular, FIG. 11 shows the optimized printing density characteristic relative to the relationship between the thermistor temperature and the standard pulse width, TW.

Characteristics curve 91 is a plot of the central or optimum values over the designated temperature range that brings about optimized printing density and printing quality. Characteristic curve 92 is the upper limit characteristics and characteristic curve 93 is the lower limit characteristics. Shaded area 64, therefore, represents the range in which excellent printing density and print quality can be achieved for above mentioned parameters.

Figure 12:
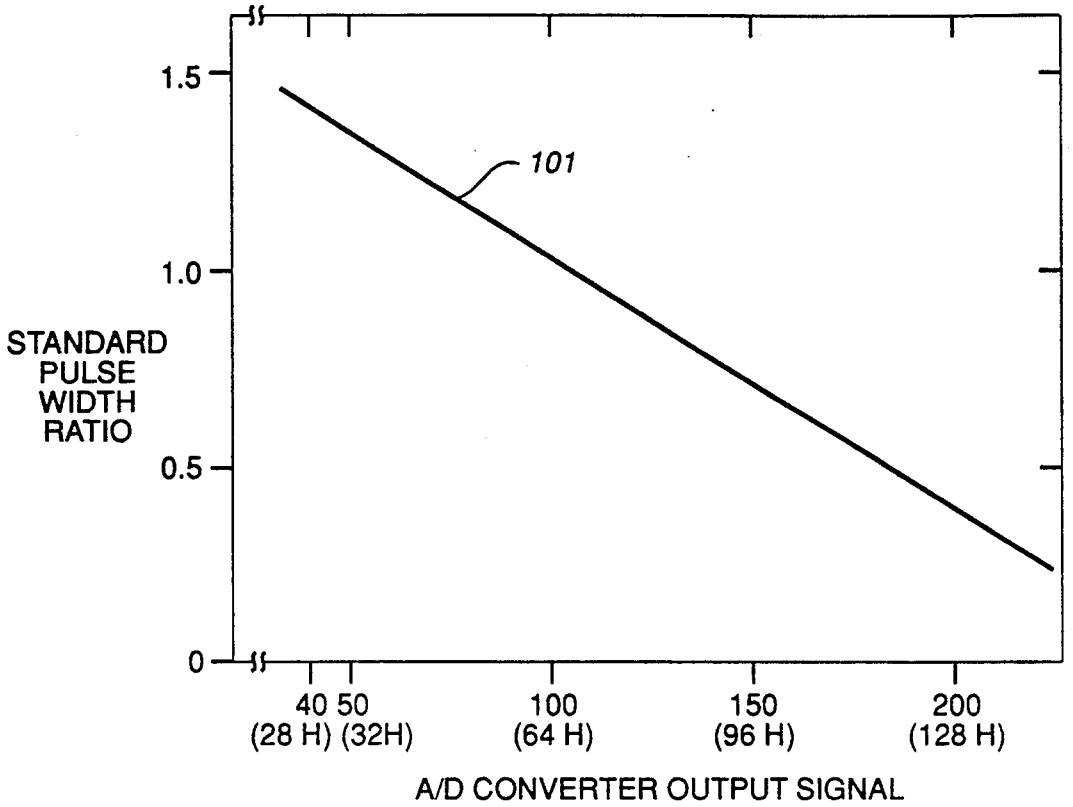

FIG. 12 is a graph illustrating the relationship between the standard pulse width ratio of the center optimized characteristic curve 91 of FIG. 11 and the output values of A/D converter 15A. The vertical axis shows the ratio of the pulse widths and the horizontal axis shows the value detected by A/D converter 15A. As is clear from FIG. 12, characteristic curve 101 is substantially linear. This characteristic can be expressed by the function h=f(s), wherein "h" is the standard pulse width ratio and "s" the output value of the A/D converter expressed in decimal numbers. If the standard pulse width ratio is designated as "h" and the output value of the A/D converter is designated as "s", then:

$$h=1.66-(0.91/1.46)\times s10^{-2}.$$

Thus, it can be seen that the relationship between the A/D converter output value and the heating element current flow pulse width ratio, the pulse width can be linearly approximated. Compared to a method described relative to the first embodiment employing and retaining table values, a more simplified approach to temperature tracking is possible because of this linear expression between the standard pulse width ratio and A/D converter output signal on data bus 15D. As a result, it is possible to reduce the processing time and provides a major benefit toward increasing the speed of operation of the thermal printer, particularly relative to high speed terminal thermal printers.

Relative to the means in ROM 12 for recognition of the pulse width ratio/pulse width relationship, if the optimized pulse width differs from this example due to the type of ink ribbon or the type of thermal print head, it will not only be possible to provide a linear equation, but it will also be possible to express the functions, etc., with secondary or quadric curves and logarithmic curves, etc. Even combinations of functions are possible.

In addition to being a linear equation, the means for recognition of the pulse width ratio/pulse width relationship may also be a software program stored in ROM 12 for the purpose of executing a series of process steps based on desired functions, which is accomplished by those skilled in the art of programming. Since the function expressed above is linear, a program can be easily created to provide for the calculation of the standard pulse width value from the A/D converter output value. In this approach, the software program as a means for recognition of the pulse width ratio/pulse width relationship can also be expanded to calculate each pulse width for current flow intervals, $t_0$, $t_1$, $t_2$ and $t_3$.

A variety of methods can be employed for determining the current flow pulse width, TW, for heating elements 1A with the output value of the A/D converter as a standard. For example, the value of the current flow interval can be easily found by determining the standard pulse width, TW, from the standard value detected by A/D converter 15A and calculating with the designated ratio.

The current flow interval signal generation circuit is formed by the current flow interval data output device (timers 14) and current flow standard value generating circuit 34.

The method of using the previously described means of recognition to determine the applied pulse widths for heating elements 1A can be applied not only to the thermal printer than controls the current flow time in correspondence with the past drive history, previously described, but also can be applied to products, such as, low-cost thermal printers and line printers which do not require high-speed operation. In particular, the fact that the relationship between the output values of A/D converter 15A and the current flow pulse width, TW, can be linearly approximated is a very important factor in providing low cost printers to consumers.

Figure 13:
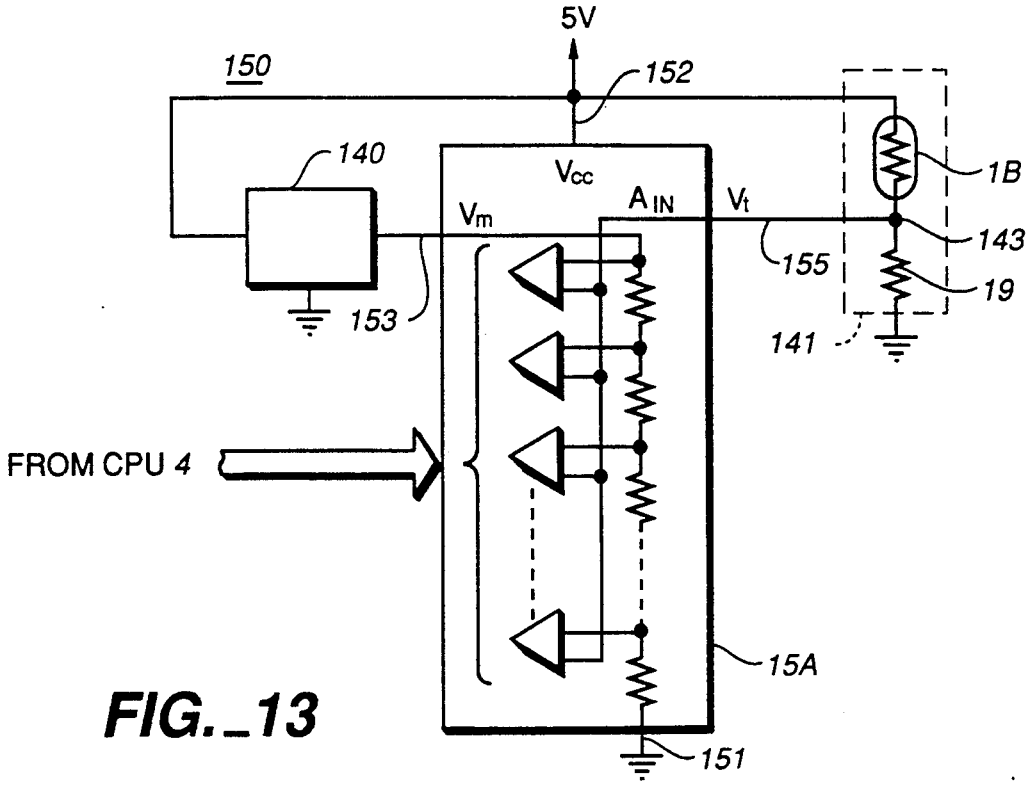
Figure 14:
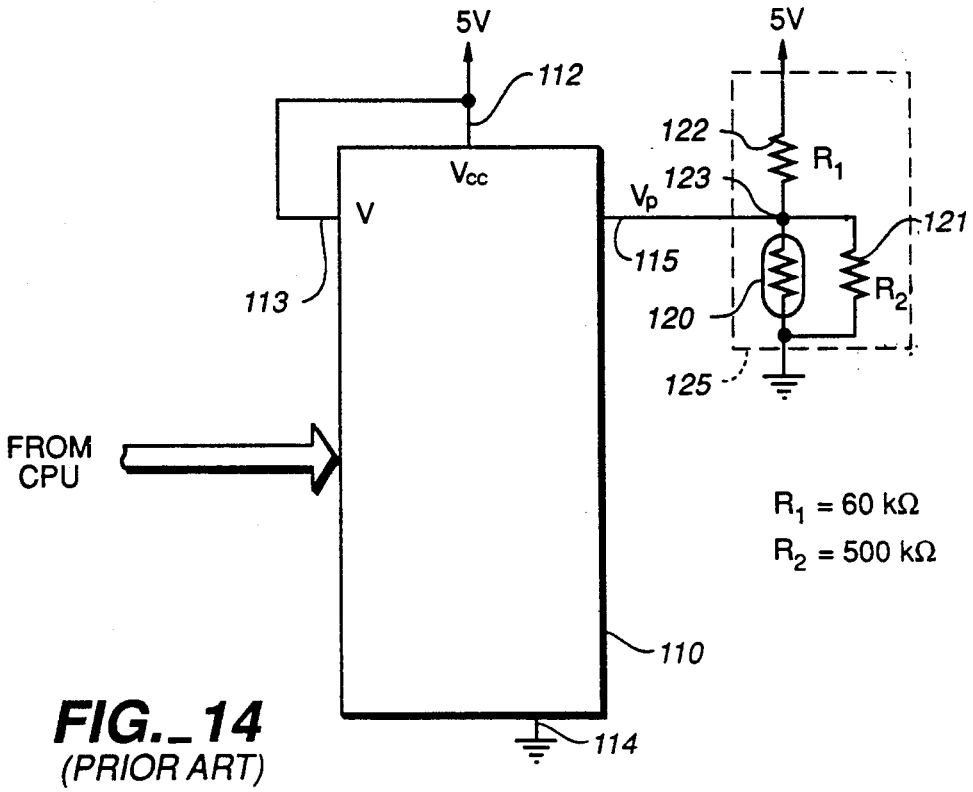
FIG. 14 (PRIOR ART)
Figure 15:
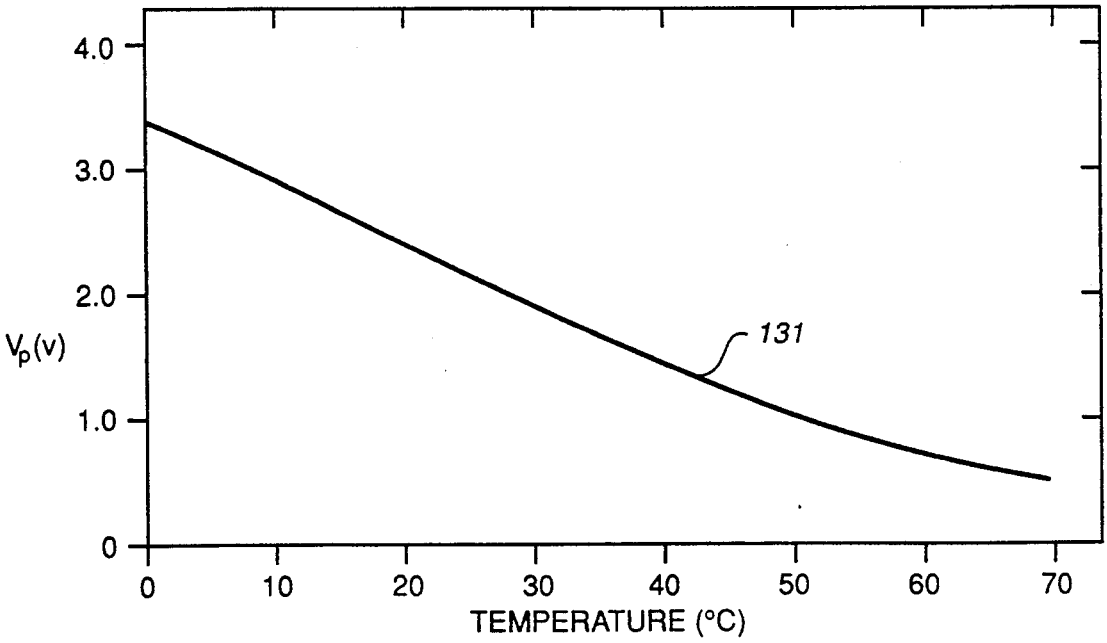
FIG. 15 (PRIOR ART)

FIG. 13 is a schematic diagram of a standard value generating circuit 150 that may be employed relative to the second embodiment of this invention. Components in FIG. 13 that have the same numerical identification as shown in FIG. 1 are not described here but the previously description is equally applicable to this embodiment of circuit 150. Constant voltage circuit 140 and a voltage divider circuit 141 linearizes the characteristics of thermistor 1B. Constant voltage circuit 140 is provided between the power supply, which supplies the voltage divider circuit of thermistor 1B and resistor 19, and detection range input 153 of A/D converter 15A. It supplies low electrical potential from voltage divider circuit 141. Constant voltage circuit 140 comprises a high-accuracy 3-pin regulator. In general, thermistor 1B can be place on either the positive side or the negative side of the power supply. However, in this invention, it has been on the positive side of the power supply. This has an important meaning, which will be described in further detail later in the description. Input 152 to A/D converter 15A is positive voltage supply and input 151 to A/D converter 15A is reference or negative ground. Input 155 is the detection electrical potential input, $V_t$, from the divider point 143 in voltage divider circuit 141.

In this particular example, fixed resistance employed for the divider circuit 141 have not been placed in parallel with thermistor 1B. However, if necessary or desired in achieving optimized printing quality, the fixed resistance employed may be connected in parallel in order change the characteristics. This is desirable when printing quality needs to be changed or optimized because, in particular, serial thermal printers are sensitive to changes in printing parameters, such as the terminal head combination, ink ribbon recording medium or printing speed. The characteristic of each pulse width can be changed by placing a resistance in divider circuit 141 to adopt to changed conditions in the type the printer and its parameters.

A/D converter 15A provides an 8-bit binary code output by converting the electrical potential, $V_t$, into a digital representation. The representation can be one of 255 step values, and the maximum detection voltage has been set to $V_m=4$ volts via detection range setting input 153 of A/D converter 15A. If the maximum detection voltage were 4 volts, a resolution of 15.7 mV per step value can be achieved.

Characteristic curve 61 of FIG. 6 has a slightly different temperature range for each voltage interval because of its non-linear nature. However, the temperature of thermal print head 1, via CPU 4, can be detected and optimal current flow conditions can be established in accordance with the printing conditions of the printing mode and other set parameters by apparatus of directly detecting the electrical potential, $V_t$, through binary code conversion. Further, this detection process can be accomplished over a wide range of temperature conditions at thermal print head 1. As is clear from the characteristic curve 61 of FIG. 6, the range of detected electrical potential, $V_t$, is expanded from 0° C. to 60° C., and at 40° C. and above, there is no tendency toward no saturation. This has important factor for the control of the thermal print head because, at 40° C. and above, fine control of current application to heating elements 1A is required to control the accumulation heat in head 1. If the characteristic curve 61 displayed saturation characteristics, the detection accuracy of A/D converter 15A would deteriorate and accurate thermal print head temperatures could not be detected. However, at lower head operating temperatures, e.g., below 40° C., rapid heat accumulation does not exist so that there is a small pulse width change for changes in thermal print head temperature. Thus, a these lower temperatures, such fine detection accuracy is not required.

As a result, the detection electrical potential, $V_t$, of A/D converter 15A requires characteristics that will not saturate at 40° C. or higher. Further, if the electrical potential, $V_t$, of voltage divider point 143 of voltage voltage divider circuit 141 approaches the voltage of the power supply, saturation will take place. However, in this invention, in order to eliminate this from the A/D converter detection range, an electrical potential lower than the voltage divider circuit is provided as the upper limit so that the detection temperature upper limit will be from 65° C. to 70° C. via the setting placed on detection range setting input of A/D converter 15A.

Figure 16:
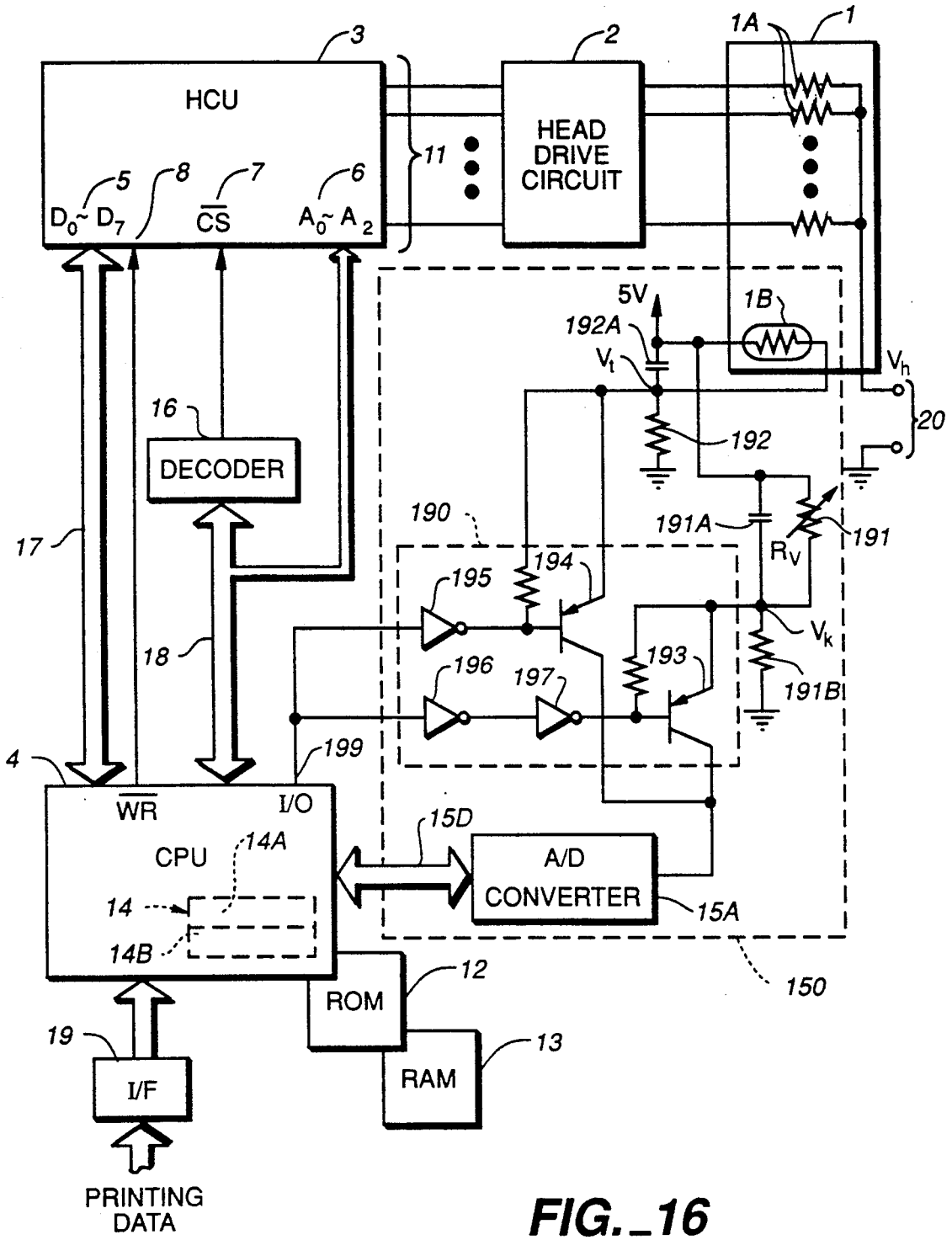
FIG. 16 is a partial circuit diagram for a thermal printer employing a third embodiment of the drive control apparatus of this invention.

FIG. 16 is a partial schematic circuit of a third embodiment of thermal printer drive control apparatus comprising this invention. The description for components in FIG. 16 that have the same numerical identification as components in FIG. 1 and is not repeated as their description in FIG. 1 is equally applicable to FIG. 16.

In FIG. 16, standard value generating circuit 150 detects the temperature of thermal print head 1 and generates the current flow time standard value of heating elements 1A as well as detect the resistance of variable resistor 191 in order to adjust the printing density and generate a density standard value. Circuit 150 comprises thermistor 1B that is positioned to detect either the temperature of baseplate material ID of thermal print head 1 or detects the temperature of its heat sink 10. Circuit 150 comprises selection circuit 190 having an input connected to an I/O port of CPU 4 via line 199. Circuit 190 comprises input inverters 195 and serial connected inverters 196 and 197. The output of inverter 195 is connected to the base of transistor 194 and the output of inverter 197 is connected to the base of transistor 193. Circuit 150 also includes dividing resistor 192 connected to the emitter of transistor 194 of selection circuit 190 and to capacitor 192A, which is connected to the power supply. Thermistor 1B is connected on one side to the power supply and is connected in parallel with capacitor 192A. Further, the other side of thermistor 1B is connected to the emitter of transistor 194 and is one voltage divider point electrical potential, $V_t$, relative to this embodiment. On the other hand, variable resistor 191 is connected in parallel with capacitor 191A and are connected on one side to thermistor 1B and the power supply and are connected on the other side to dividing resistor 191B and the emitter of transistor 193 and is other voltage divider point electrical potential, $V_k$, relative to this embodiment. Capacitors 192A and 191A stabilize output electrical potentials $V_t$ and $V_k$. Thus, circuit 150 provides means to generate voltage divider point electrical potential, $V_t$, via first voltage divider circuit comprising thermistor 1B and resistor 192, and means to generate voltage divider point electrical potential, $V_k$, via a second voltage divider circuit comprising variable resistor 191 and resistor 191B. Either voltage divider point electrical potential, $V_t$ or $V_k$, is selected via command input on input line 199 from CPU 4 to selection circuit 190 and one of these potentials is set onto detection input 15B of A/D converter 15A. As is similar in connection with previous embodiments, circuit 150 generates binary codes in cyclic operation with commands from CPU 4, via input 199, and provides code data on data bus 15D.

In recent years, an 8-bit A/D converter like converter 15A are provided as part of the CPU. Therefore, it is possible to reduce the expense of a thermal printer system by employing a CPU with an integrated A/D converter.

Standard value generation circuit 150 has the same characteristics as those exhibited in FIG. 6, which shows the relationship between temperature of thermistor 1B and electrical potential $V_t$. Moreover, the memory circuit of ROM 12 includes the primary memory table, relative to the relationship in FIG. 6, as well as contains the secondary memory table relative to the mode/interval value relationship in FIG. 8.

FIG. 17 is sets forth resistance $R_v$ when the maximum resistance of the density adjustment resistor is 50 kilohms and when the resistance of the resistors connected in series to this one is 50 kilohms. FIG. 17 also provides the data table within ROM 12, which provides the relationship between the output electrical potential, $V_k$, of the second divider circuit and the temperature correction value. In addition to the data table for the first divider circuit, illustrated in FIG. 7, and the second divider circuit data table, ROM 12 also contains a third data table to determine the density correction value.

The density correction value is expressed as a coefficient that shows the increases and decreases in the pulse width, TW. This resistance is determined from the value detected by A/D converter 15A. The density correction value (coefficient) is determined from the data table and the standard pulse stipulated value 76 is multiplied by this density correction value. Printing at the desired density becomes possible by means of the CPU calculating and employing the standard pulse width and the pulse widths of each current flow interval as new stipulated values. The determination of the resistance is actually the same as in the case of FIG. 7. The relationship between the binary code and the coefficient is stored in ROM 12 as the third data table.

As a specific example, with resistor 191 set to 50 kilohms, and with $R_v=30$ kilohms, an electrical potential of $V_k=3.13$ volts will be generated. This electrical potential value will be referenced from the data table within ROM 12 and density correction value 0.9 will be found. After the standard pulse width ratio that corresponds to the thermistor temperature from the data table represented in FIG. 7 has been determined, standard pulse width, TW, can be calculated by once again multiplying standard pulse width ratio with the correction value.

Figure 18:
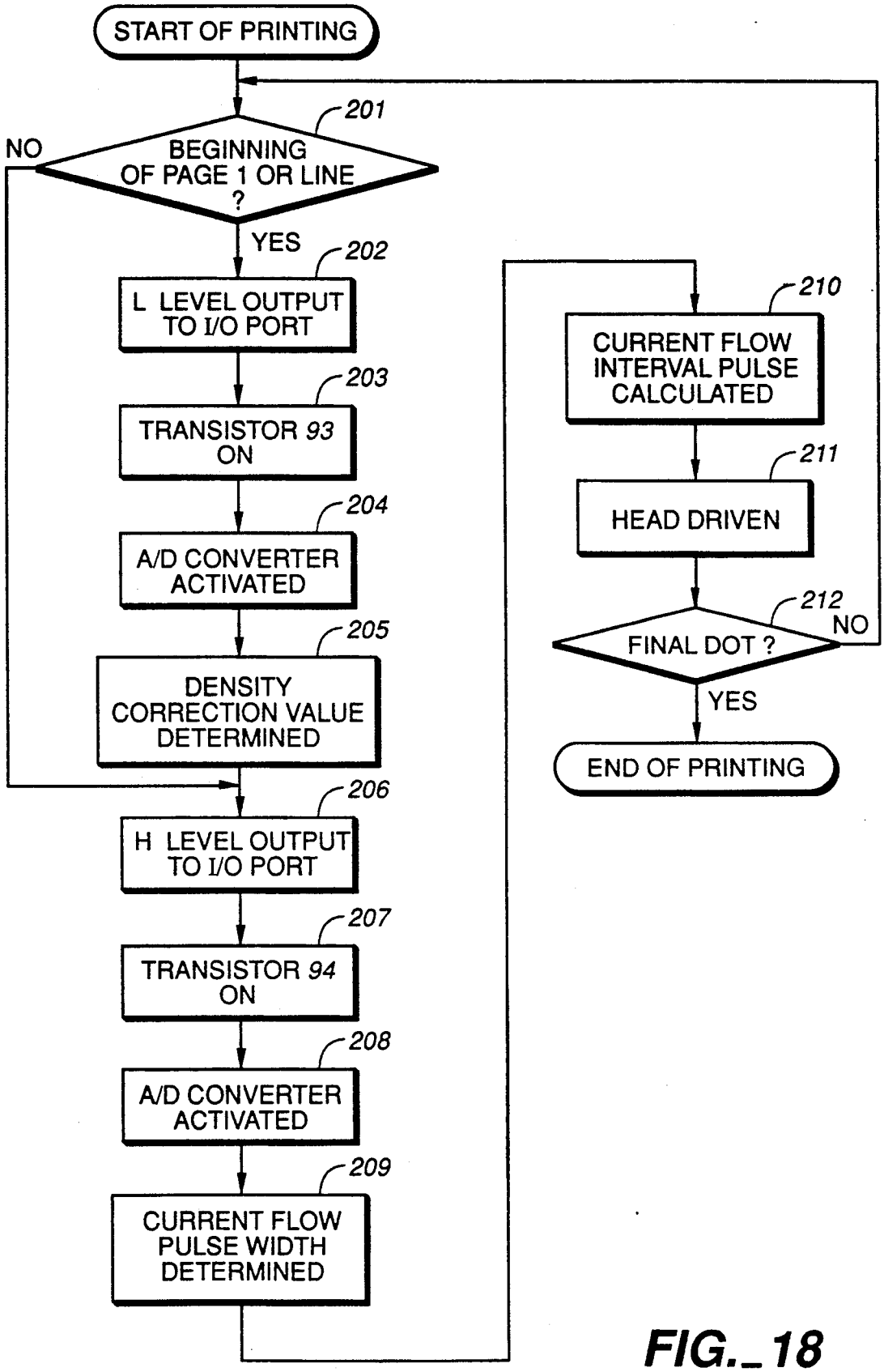
FIG. 18 is a flowchart of the printing operation for the thermal printer drive control apparatus of FIG. 16.

Reference is now made to the flowchart of FIG. 18 in explaining the printing operation of the thermal printer drive control apparatus of this embodiment in conjunction with the head drive timing previously described in connection with FIG. 9. First of all, a determination is made of whether or not the print position is at the beginning of the first line or not (Step 201). If this is the first line, the L level is provided as an output to I/O port 199 (Step 202). If it is the beginning of the first page, the H level is provided as an output to I/O port 199 (Step 206). In the former case, transistor 193 is turned ON via a signal from CPU 4 on line 199 (Step 203), and potential, $V_k$, is provided as input to A/D converter 15A. CPU 4 operates the A/D converter 15A (Step 204) and from this electrical potential a determination is made of the density correction value based on the third data table set in ROM 12 (Step 205) and this value is stored in the RAM 13. Next, just before the shift to page drive, the H level is output to I/O port 199 (Step 206), transistor 194 is turned ON (Step 207) and the potential, $V_t$, is provided as input to A/D converter 15A.

As previously indicated, current flow cycles $T_0$, $T_1$ and $T_2$ are determined by timer 14. In addition to the current flow cycles, timer 14 is also the basic clock for a stepper motor (not shown) that transversely moves thermal print head 1.

Standard value generation circuit 150 is accessed in cyclic operation with the current flow cycle and the A/D converter output code is detected by CPU 4 (Step 208). The first data table is referenced and standard pulse width, TW, which corresponds to the thermal print head temperature, is determined from the second data table and the third data table (Step 209). The correction value stored in RAM 13 is reference and each current flow interval, $t_0$, $t_1$ . . . $t_n$, is calculated (Step 210). At the next timing cycle, the pulse width values of the primary current flow interval, $t_0$, and the secondary current flow intervals, $t_1$–$t_3$, are provided to heating elements 1A and alternately counted by timer circuits 14A and 14B. These intervals will then be provided as output times for drive signals H0–H23 by HCU 3 through access by HCU 3 of the designated address, A0–A2, via decoder 30 (Step 211). As an example, the procedure is such that after interval $t_3$ has been set into timer circuit 14A and during the operation of timer circuit 14A, interval $t_2$ is set into timer circuit 14B. Once the counting operation of timer 14A is completed, timer circuit 14A will commence operation and interval $t_1$ will be set into timer circuit 14B. By employ two or more timer circuits in this manner, highly accurate time intervals can be obtained and accurate current flow control is possible without affecting the CPU processing speed. In addition, the processing of the timer output also employes the CPU internal interrupt function so that the delay time is minimized. CPU 4, which is equipped in this manner with a plurality of timer circuits, doubles as a current flow interval data output device. The reading of pulse width, TW, takes place at each designated head drive cycle, and is able to prevent heat accumulation and bring about excellent print quality by making it correspond to the thermal print head temperature, which is in continuous change.

During the printing operation, the pulse width can be set to the optimal value at the time basically by operating A/D converter 15A at one-dot cycles and detecting the temperature of thermal print head 1. However, in the slow, low-speed, print mode, this is not necessary because the rise in the temperature of thermal print head 1 is not an acute rise. In addition, CPU 4 reads the data tables that correspond to the print modes, converts these into cycle signals and provides them as output so that the widths of the total current flow time and the current flow intervals are varied on the fly and the current flow signals are provided as output in accordance with printing mode selection parameters.

Upon the completion of each designated adjustment volume, determination is made as to whether or not the final dot line has been reached. If this is not the case, the series of printing operations described above are repeated (Step 212). As indicated in the flowchart of FIG. 18, it is sufficient to execute the setting of the density adjustment volume at the thermal print head of the thermal printer to be designated as one time per line or one time per page. However, the adjustment volume may also be made to occur one time per dot line.

Relative to the third embodiment just described, the printing density correction value and the standard pulse width can be found from the standard value detected by A/D converter 15A and the current flow interval value can be easily determined by calculating this value with the designated ratio. Moreover, until now, the density adjustment volume was generally varied by varying the thermal print head power supply voltage $V_h$. However, the thermal print head is sensitive to the application of high voltages and could be a dangerous fire hazard. As a result, during product design in achieving maximum density volume, it was necessary to pay close attention not to exceed the maximum rated voltage of the thermal print head. However, in connection with the drive control apparatus of this invention, a built-in malfunction diagnosis function exists because even if the designed density volume were damaged, any applied energy exceeding the printing variation range placed into the third data table in ROM 12 will not be applied to thermal print head 1. Also, damage to the thermal print head can be avoided and high reliability can be realized by adopting a system that adjusts the printing density by maintaining a fixed power supply voltage and providing drive control apparatus to varying the pulse width of the head drive signals.

Figure 19:
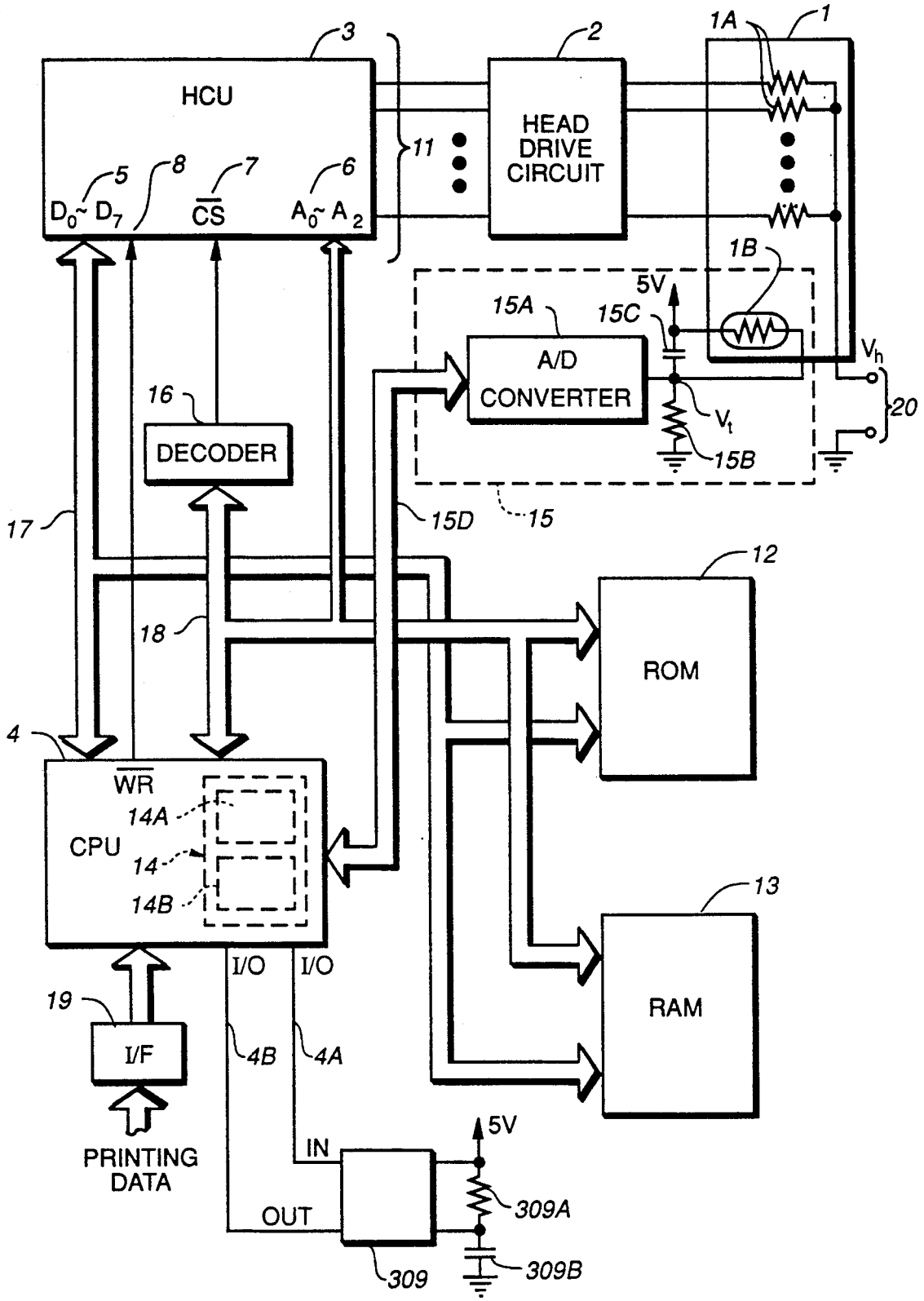
FIG. 19 is a partial circuit diagram for a thermal printer employing a fourth embodiment of the drive control apparatus of this invention.

FIG. 19 is a partial schematic circuit of a fourth embodiment of thermal printer drive control apparatus comprising this invention. The description for components in FIG. 19 that have the same numerical identification as components in FIG. 1 are not repeated here, as their description in FIG. 1 is equally applicable to FIG. 19. The fourth embodiment of FIG. 19 is particularly applicable for a terminal thermal printer.

The circuit of FIG. 19 differs from the circuit of FIG. 1 in that a retriggerable one-shot timer circuit 309, available as National Semiconductor Corporation LM555/LM555C timer, is provided to detect relatively long time periods time wherein there is an absence of printing operation in order to have CPU 4 check the ambient temperature conditions at thermal print head 1. Circuit 309 includes resistor 309A and capacitor 309B which form a delay time detection circuit for the purpose of detecting whether or not a predetermined printing delay time has elapsed. One-shot timer circuit 309 is connected to CPU 4 via I/O ports 4A and 4B. In operation, during the printing operation, timer 309 receives a level change on I/O port 4A. At this time, the level output on I/O port 4B from timer 309 will change state, e.g., to a high level. Then, after an elapse of a predetermined time, determined by the time constant of RC circuit 309A, 309B, the level output on I/O port 4B from timer 309 will again change state, e.g., to a low level. At this point in time, CPU 4 will then preform an ambient temperature detection if the printing operation has already terminated. Thus, whether the designated printing delay time has elapsed can be ascertained from the output level on line 4B from the time that the trigger in circuit 309 is OFF during the printing operation until the printing operation terminates. From timer 309, CPU 4 can determine when a check for ambient temperature at head 1 should be made.

Because it is difficult to utilize one thermistor for detecting both the temperature of thermal head 1 and ambient temperature, timer 309 can be employed to permit CPU 4 to determine when the temperature of thermal print head 1 decreases to ambient temperature after printing operation has terminated, i.e., provided a delay after printing operation has ceased in order that CPU 4 can then determine the ambient temperature of head 1.

Figures 21, 23:
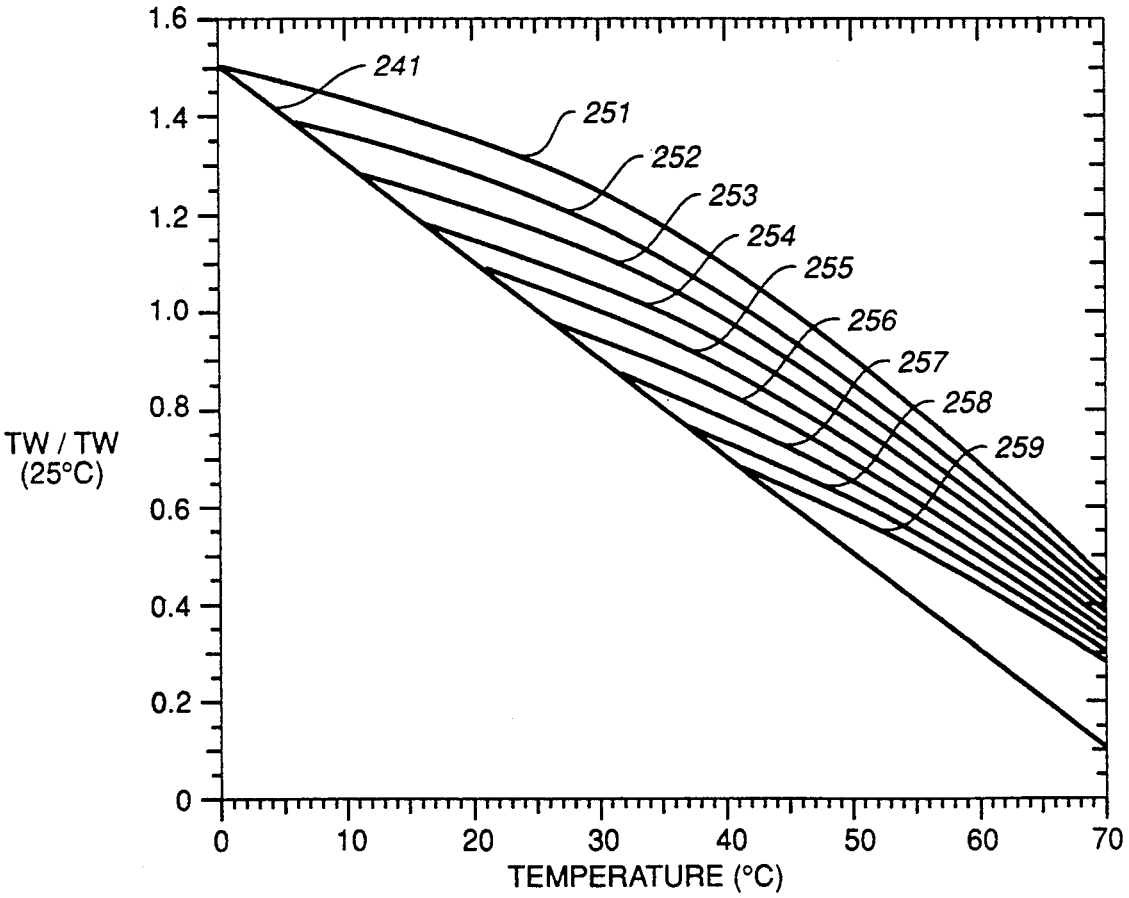
FIG. 21 is an explanatory diagram of an example of the initial data table within the memory system utilized in this invention and shows the pulse width correction coefficient relative to ambient temperature.
FIG. 23 is a characteristics diagram that shows the relationship between changes in the ambient temperature and the current flow pulse width versus changes in thermal print head temperature.

Reference is now made to FIG. 23 which shows the relationship between ambient temperature changes and current flow pulse width changes versus temperature changes at thermal print head 1 relative to the embodiment of FIG. 19. The vertical axis of FIG. 23 shows the ratio of the pulse width for conditions when the pulse width is at 25° C. and the horizontal axis shows thermal print head temperature.

Curve 241 in FIG. 23 represents the ideal characteristics curve for changes in standard pulse width ratio versus changes in ambient temperature, which is linear. The family of characteristics curves 251–259 represent the relationship between the standard pulse ratio and the print head temperature, and they represent the optimal relationship for various ambient temperatures providing for the best printing quality. The characteristics are for ambient temperatures from 0° C. (251) to 40° C. (259) in steps of 5° C. The thermal print head temperature starts with the ambient temperature because although operation initialization will naturally take place, the thermal print head, of course, never reaches a temperature below the original ambient temperature until printing ceases for an extended period of time. Actually, the optimal characteristic changes continuously with the ambient temperature.

The following facts are ascertained from an examination of characteristic curves 251–259:

(1) The rate of change in applied energy relative to a temperature change occurring at a head incorporating a thermistor 1B is smaller than the rate of change in applied energy relative to a change occurring in ambient temperature.

(2) It is necessary to reduce the applied energy almost linearly with a rise of ambient temperature.

(3) The rate at which the applied energy to the head has to be decreased with a continuous rise in head temperature occurring during head operation, gradually increases as the head temperature progressively increases.

(4) When the print head starts to be driven at an ambient temperature, the rate at which the applied energy has to be decreased with an increase of the print head temperature (reduction rate p) is smaller than the rate at which the applied energy has to be decreased with an increase in ambient temperature (reduction rate q). In short, the slant angle for characteristic curve 241 is larger than any slant angle for characteristic curves 251 to 259, particularly in with respect to the start of these curves from ambient temperature to the range of 20° C. to 30° C.

(5) In other words, the relationship of reduction rate, p, being smaller than reduction rate, q, i.e., $p<q$, has to be maintained when the thermal print head is driven from any point within ambient temperature at the start or commencement of printing.

Thus, the use of one thermistor is possible to compensate the pulse width, TW, in accordance with ambient temperature at thermal print head 1, according to the characteristics indicated in FIG. 23. With the use of one thermistor for detecting temperature conditions at head 1, a timer, such as timer 309, can be employed to detect for ambient temperature during delays in printing operation. However, it should be noted that two or more thermistors may be employed in the detection scheme of this invention. As an example, two thermistors may be employed, one for detecting head temperature and the other for detecting ambient temperature.

Figure 22:
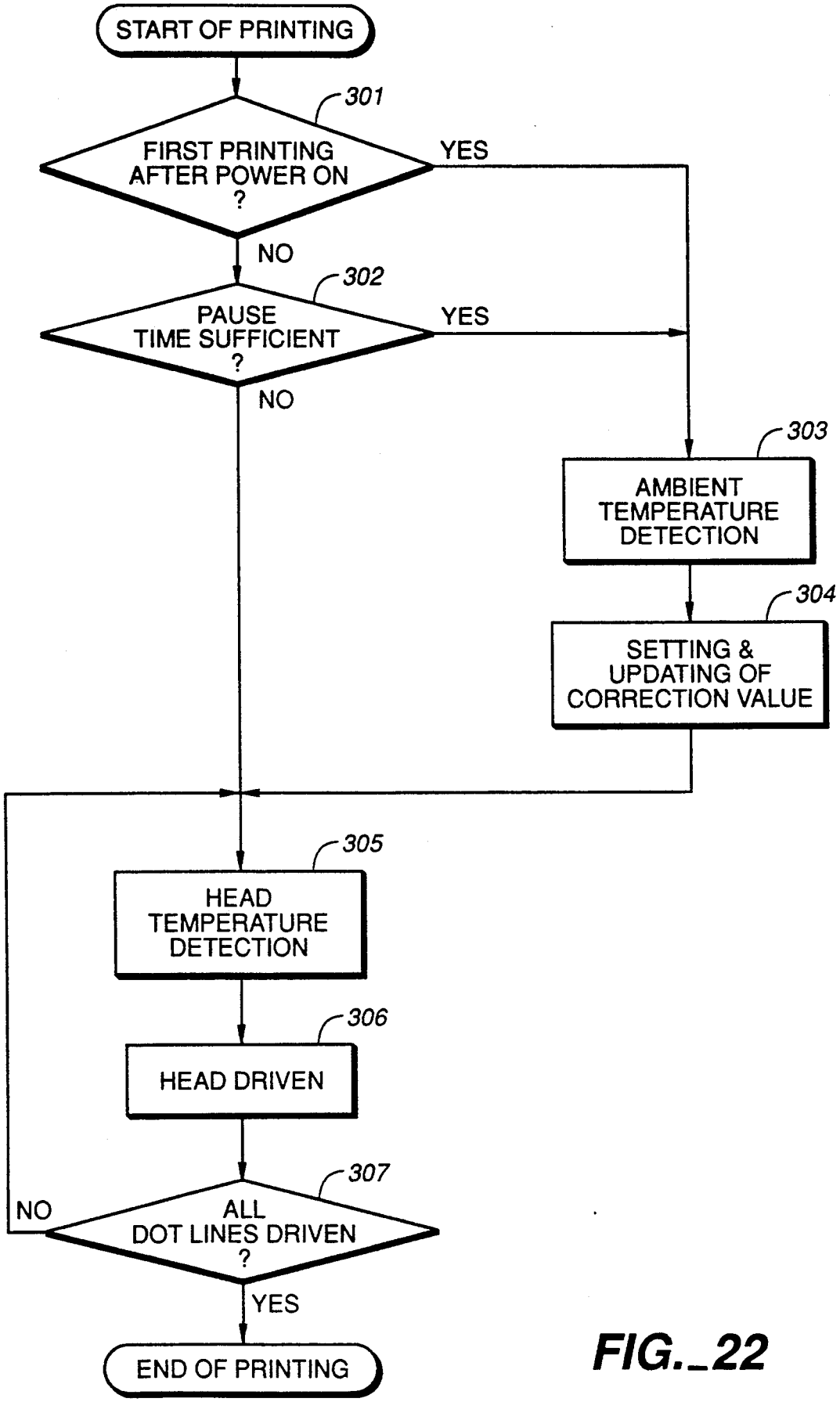
FIG. 22 is a flowchart of the printing operation for the thermal printer drive control apparatus of FIG. 19.

FIG. 19 is an example of drive control apparatus that is optimal for the forgoing characteristics and will be exemplified in detail relative to FIGS. 20–22.

The relationship between the temperature of thermistor 1B of standard value generating circuit 150 is the same as that shown in FIG. 6. If the standard resistance of thermistor 1B at an ambient temperature of 25° C. is $R_{th}$, then characteristic curve 61 in FIG. 6 is applicable when $R_{th}$, = 50 kilohms and when the resistance of resistor 15B is $R_k$=25 kilohms. A/D converter 15A converts the electrical potential, $V_t$, into a digital representation for presentation on data bus 15D. If 8 bits of data represents 255 step values and the maximum detection voltage is 4 volts, a resolution of 15.7 mV per step value can be achieved. The maximum detection voltage can be set for A/D converter 15A via its $V_m$ input.

FIG. 20 illustrates the first data table within ROM 12 and characterizes the relationship between the A/D converter output code and the current flow time standard pulse width. The table comprises thermistor temperature table 271, $V_t$ output value table 272; A/D converter output values, i.e., standard values table 273, and standard pulse width ratio table 274; standard pulse width table 275, and standard pulse width stipulated value 276. The relationship of table 273 and table 274 and the stipulated value 276 of the standard pulse widths are stored within ROM 12 as first data table 277. As a result, the CPU can set the standard pulse width, TW, by detecting the A/D converter output code as a standard value. Standard pulse width, TW, is determined from the stipulated value 276 of the standard pulse width and the standard pulse width ratio. The standard value of pulse width ratio, 1.00, employes 25° C. as a standard. Table 273 is shown written in hexadecimal code but is stored in ROM 12 in binary code.

In addition, code table 273 and standard pulse width table 274 are held as data in 1° C. units in order to provide for further subdivision and ultimate accuracy. However, it is also possible to hold these values in 10° C. units, complement the units linearly and approximate the table values in between 10° C. units. Based on experiments, the characteristics of the ratios of the standard pulse width can be optimized by matching them to the heat accumulation characteristics of thermal print head 1. Normally, it is very difficult to match the circuit characteristics to these optimal characteristics in a printer system that employs a pulse generation circuit that has placed a thermistor into saturation. However, in a system that employs an A/D converter, it is known that the temperature characteristics curve can be freely selected to avoid this difficulty.

FIG. 21 shows a further data table in ROM 12 for the correction coefficient of the ambient temperature pulse widths. With 25° C. as coefficient 1.00, the standard pulse width can be determined by multiplying the coefficients in FIG. 21 based on the ambient temperature. For example, if the ambient temperature is 10° C., and A/D converter 15A detects the temperature of thermal print head 1 before printing, the temperature detected is ambient temperature. Since the standard pulse width 276 is 400 μs, the first standard pulse width will be 400×1.18 (correction coefficient at 10° C. in FIG. 21)×1.10 (standard pulse ratio at 10° C. in FIG. 20)=519 μs. Next, after energization of thermal print head 1, head temperature will become higher and higher step by step due to an accumulation of increased temperature. When the head temperature becomes 20° C., the standard pulse width becomes 400×1.18 (correction coefficient at 20° C. in FIG. 21)×1.04 (standard pulse ratio at 20° C. in FIG. 20)=491 μs. In this sense, the ambient temperature does not change and the correction coefficient originally obtained is continually employed during a printing operation until printing terminates at which time CPU 4 again checks for ambient temperature after time out (Step 302). If the ambient temperature is checked and determines that it is 20° C., then the correction coefficient is changed to 1.12 per the table in FIG. 21.

For the detection of the ambient temperature when employing an A/D converter that detects thermal print head temperature, and if the pause time detection circuit indicates that the head pause time has exceeded the designated time, the head temperature detected immediately prior printer operation will be close to the ambient temperature. The designated value of the pause time will change with the size of the thermal print head. In general, with serial-type thermal printers, ambient temperature is reached in about 3 to 5 minutes. However, with line-type thermal printers, ambient temperature is reached in about 20 to 30 minutes and, therefore, it is necessary to set the designated value of the pause time according to the size of the head.

Reference is now made to the printing operation employing the drive control apparatus for the fourth embodiment shown in FIG. 19 in conjunction with the head drive timing previously described in connection with FIG. 9. In this connection, reference is made to both FIGS. 9 and 22. Before printing begins, the pause time detection circuit detects whether this is a first printing after the power was turned on (Step 301) and whether a sufficient amount of time has elapsed since the last printing (Step 302). If it is a first printing or if a sufficient amount of pause time has elapsed, A/D converter 15A will operate and detect the ambient temperature (Step 303). Next, based on the ambient temperature, the pulse width correction value will be determined from the data table of FIG. 21 in ROM 12 and the result stored at the designated address of RAM 13. If it is not the first printing, the pulse width correction value will be updated (Step 304). After this, the thermal print head will be driven while the head temperature is being detected at each designated cycle (Steps 305 and 306). From the output value of standard value generating circuit 15 and from the correction value determined from values in the first and second data tables in ROM 12, the pulse widths of each current flow interval can be easily determined.

As previously indicated, FIG. 9 shows the head drive timing and $T_0$, $T_1$ and $T_2$ indicate current flow intervals. These are determined by timers 14 employed for determining the current flow cycle. In addition to the current flow cycles, the current flow intervals are also the basic clock for the stepper motor (not shown) that transversely moves thermal printer head 1 of a serial type printer.

CPU 4 accesses standard value generating circuit 15 in cycle with the current flow cycles and detects the 8-bit output code of A/D converter 15A. CPU 4 then references the first data table in ROM 12 and calculates the standard pulse width, TW, which is based on the temperature of thermal print head 1. CPU 4 then references the second data table in ROM 12 and calculates each current flow interval, $t_0$, $t_1$. . . $t_n$. At the next timing cycle, CPU 4 will alternately employ its timer circuits 14A and 14B and synchronize to alternating output times provided to HCU 3, i.e., count both the pulse width values of the primary current flow intervals and secondary current flow intervals to heating elements 1A that match the current flow intervals, and outputs these values as cycle signals by accessing the specified addresses, A0–A2, to HCU 3. For example, after $t_3$ is set in timer circuit 14A, $t_2$ will be set into timer circuit 14B while timer 14A is in operation. When the count operation for $t_3$ in timer circuit 14A has terminated, timer 14B will commence operation and $t_1$ will concurrently be set into timer circuit 14B. By alternately employing a pair of timer circuits in this manner, highly accurate time can be obtained and accurate current flow control is possible without affecting CPU processing speed. In addition, the processing of the timer outputs employes the CPU internal interrupt function so that delay time is minimized. CPU 4, which is provided with a plurality of timer circuits, therefore, doubles as a current flow interval data output device. The reading of pulse width, TW, takes place at each designated cycle of the head drive, and is able to prevent heat accumulation and bring about excellent print quality by rendering the pulse width, TW, to correspond to the current thermal print head temperature, which temperature is in continuous change. While the built-in timers 14 of the CPU 4 may be utilized as indicated above, it is also acceptable to provide separate timers for this function external of CPU 4.

During the printing operation, the pulse width can be set to the optimal value at the time by basically operating A/D converter 15A at one-dot cycles and detecting the temperature of thermal print head 1. However, in the slow, low-speed print mode, this is not need necessary in one-dot cycles because the rise in the temperature of thermal print head 1 is not a sharp temperature rise. In addition, CPU 4 reads the data tables in ROM 12 that correspond to the designated print modes and converts these into cycle signals and outputs them so that the widths of the total current flow time and the current flow intervals are varied relative to temperature changes at thermal print head 1, and the current flow signals are provided as output in accordance with printing mode selection parameters.

Relative to the embodiment of FIG. 19, the standard pulse width can be found from the standard value detected by the A/D converter, and the value of the current flow interval can be easily determined by calculating with the designated ratio. The pause time detection circuit in this embodiment comprises a one-shot timer 309. However, a timer as part of the integrated circuit on a CPU chip may also be employed.

In all the foregoing embodiments, the detection of the ambient temperature is possible without the need for two thermistors. Also, a fine degree of temperature control of printing elements 1A renders a sufficiently significant difference in printing characteristics due to the differences in the thermal transfer and the differences in the ink ribbons employed. In this way, one thermal printer model can handle a variety of different types of ink ribbons, such as color ribbons and reusable ribbons, and still provide high quality thermal printing brought about by the thermal head drive control apparatus of this invention.

While the invention has been described in conjunction with several specific embodiments, it is evident to those skilled in the art that many further alternatives, modifications and variations will be apparent in light of the foregoing description. Thus, the invention described herein is intended to embrace at such alternatives, modifications, applications and variations as fall within the spirit and scope of the appended claims.

What is claimed is:

1. A thermal printer drive control apparatus for a thermal printer operable relative to changing temperature conditions and different selected printing parameters comprising:

a thermal print head having a plurality of heating elements, detection means for detecting at least a temperature of said print head, mode selection means for detecting values selected for said printing parameters.

a processor having a data bus line and an address bus line for carrying an address designation for controlling operation of said thermal printer, storage means for storing present print data and at least one previous print data in response to address designations, said storage means coupled to said data bus line and said address designations, said storage means coupled to said data bus line and said address bus line, to permit storage of print data into said storage means, gate means coupled to said storage means for providing energizing signals with respect to each of said heating elements, said output energizing signals divided into a primary energizing interval determined according to present driving data and secondary energizing intervals determined according to previous print data, energizing control means coupled to said detection and mode selection means for calculating a corrected pulse width coefficient based upon a standard pulse width value, and current operating temperature conditions detected at said thermal print head, and for determining said primary energizing interval and said secondary energizing intervals based upon said standard pulse width as correlated to said corrected pulse width coefficient and said selected printing parameters, and current flow interval pulse generating means for receiving said energizing intervals and for providing current in response thereto as said energizing signals to said gate means.

2. The thermal printer drive control apparatus of claim 1 including:

memory storage means coupled to said processor, said energizing control means comprising lookup tables in said memory storage means for setting forth a table of relationships comprising corrected pulse width coefficients based on detected print head operating temperatures from which said processor calculates a revised standard pulse width, and a table of primary and secondary interval values based upon said selected printing parameters from which said processor calculates said energizing intervals based upon said revised standard pulse width.

3. The thermal printer drive control apparatus of claim 2 wherein said relationships are linear.

4. The thermal printer drive control apparatus of claim 2 wherein said relationships are nonlinear.

5. The thermal printer drive control apparatus of claim 1 wherein:

said energizing control means comprises timer means for serially producing individual timed pulse widths for each of said energizing intervals relative to cyclic operations of said thermal printer and said detected standard pulse widths, and said current flow interval pulse generating means separates said energizing intervals into individual energizing signals for supply to said gate means.

6. The thermal printer drive control apparatus of claim 5 wherein said timer means comprises at least two timers coupled to and running under operation of said processor to alternately produce said individual timed pulse widths for each of said energizing intervals during separate cyclic operations of said thermal printer thereby increasing its processing speed.

7. The thermal printer drive control apparatus of claim 6 wherein said timers are an integrated part of said processor.

8. The thermal printer drive control apparatus of claim 1 comprising:

heat sensitive means at said thermal print head for detecting current temperature conditions relative to said thermal print head, said heat sensitive means including:

a voltage divider circuit having a coupled resistance element and heat sensitive resistive element to provide a voltage divider point therebetween productive of an electrical potential indicative of the current temperature characteristics at said heating elements, and an A/D converter connected to receive said electrical potential and produce a digital representation thereof.

9. The thermal printer drive control apparatus of claim 1 wherein said selected printing parameters comprise paper type and application of thermal ribbon.

10. The thermal printer drive control apparatus of claim 1 wherein said selected printing parameters comprise: paper type, presence of thermal ribbon, print speed, and application of graphics mode versus character mode.

11. A method of controlling a thermal print head having a plurality of heating elements in a thermal printer operable relative to selected printing parameters wherein said heating elements are to be maintained at desired operating temperature conditions comprising the steps of:

sequentially receiving at least two print cycles of print data comprising present print data and previous print data wherein said print data is also employed in determining types of energizing signals to be applied to said heating elements, determining current selected printing parameters for said thermal print head, detecting current temperature operating conditions at said thermal print head, providing a standard pulse width value based upon standard operating temperature conditions, determining a corrected pulse width coefficient based upon current operating temperature conditions at the thermal print head, calculating a primary energizing interval and multiple secondary energizing intervals based upon said corrected pulse width coefficient and said selected printing parameters, and utilizing said calculated energizing intervals in determining pulse width lengths in the formation of each of said energizing signals for said heating elements for printing said present print data based upon a historical relation of said previous print data relative to said present print data.

12. The method of claim 11 including the step of:

generating a preheat energizing interval for selected of said energizing signals wherein a nonprinting state relative to heating elements corresponding to said selected energizing signals exists in said present print data or consecutively exists in said present and previous print data.

13. The method of claim 11 wherein said step of calculating said energizing intervals comprises the steps of:

looking up in a first memory table corrected pulse width coefficient values based upon a stored relationship between detected operating temperature values at said thermal print head and said standard pulse width, looking up in a second memory table corrected pulse width coefficient values based upon a stored relationship between different printing modes and their effect on said primary energizing interval and multiple secondary energizing intervals, and serially calculating said energizing intervals based upon said corrected pulse width coefficient values from said first and second memory tables.

14. The method of claim 13 including the step of alternately calculating said energizing intervals in a pair of timers based upon said corrected pulse width coefficient values.

15. The method of claim 11 including the step of transforming said calculated energizing intervals into individual energizing signals for printing said present print data.

16. The thermal printer drive control apparatus of claim 11 wherein said selected printing parameters comprise paper type and application of thermal ribbon.

17. The thermal printer drive control apparatus of claim 11 wherein said selected printing parameters comprise: paper type, presence of thermal ribbon, print speed, and application of graphics mode versus character mode.

18. A thermal printer having a thermal print head with a plurality of heating elements, temperature sensing means at said thermal print head, parameter selection means for determining printing parameters currently selected for said thermal print head, control means for said printer including means for detecting current operating conditions via said temperature sensing means and for providing a series of current flow intervals based upon a standard current pulse value, said current flow intervals comprising a primary current flow interval having a pulse width with correspondence to a current cycle of print data to be presented to said thermal print head heating elements and secondary current flow intervals each having different pulse widths with correspondence to historical print data of at least one sequentially previous cycle of print data, means to select certain of said current flow intervals based upon said current and historical print data and for converting said current flow intervals into print signals for the current cycle of print data for application to said heating elements, and means for changing the pulse widths of said current flow intervals based upon both the detected temperature operating conditions at said thermal print head and printing mode characteristics of said thermal printer.

19. The thermal printer of claim 18 wherein in said means for changing said current flow interval pulse widths comprises a look-up table containing different pulse width coefficients for different detected operating temperatures at said thermal print head and a second look-up table containing different print mode coefficients for different thermal printers and means to correlate said coefficients with said standard pulse width value to correct said current flow interval pulse widths relative to detected current operating temperatures as modified by particular thermal printer thermal printer characteristics.

20. The thermal printer drive control apparatus of claim 18 wherein said selected printing parameters comprise: paper type, presence of thermal ribbon, print speed, and application of graphics mode versus character mode.

* * * * *